US008720361B2

(12) United States Patent
DiBruno, Sr. et al.

(10) Patent No.: US 8,720,361 B2
(45) Date of Patent: May 13, 2014

(54) SECURITY BARRIER

(76) Inventors: Daniel A. DiBruno, Sr., Philadelphia, PA (US); Marvin Weinberger, Havertown, PA (US)

( * ) Notice: Subject to any disclaimer, the term of this patent is extended or adjusted under 35 U.S.C. 154(b) by 388 days.

(21) Appl. No.: 13/229,368

(22) Filed: Sep. 9, 2011

(65) Prior Publication Data

US 2012/0060744 A1 Mar. 15, 2012

Related U.S. Application Data

(60) Provisional application No. 61/381,788, filed on Sep. 10, 2010.

(51) Int. Cl.

| | |
|---|---|
| ***B63B 17/00*** | (2006.01) |
| ***B63G 9/04*** | (2006.01) |
| ***B63G 13/00*** | (2006.01) |
| ***E04H 17/04*** | (2006.01) |
| ***F41H 5/06*** | (2006.01) |
| ***F41H 11/05*** | (2006.01) |
| ***F41H 11/08*** | (2006.01) |
| ***F41H 13/00*** | (2006.01) |

(52) U.S. Cl.

USPC ..... 114/361; 114/240 R; 114/240 D; 114/240 E; 114/343; 114/382; 256/2; 256/23

(58) Field of Classification Search

CPC .. B63G 9/04; B63G 13/00; B63B 2017/0009; B63B 2017/0045; E04H 17/003; E04H 17/02; E04H 17/04; F41H 5/08; F41H 5/16; F41H 11/05; F41H 11/08

USPC ..... 114/240 R–240 E, 343, 361, 364, 382; 256/1–9, 11, 12, 23, DIG. 2

See application file for complete search history.

(56) References Cited

U.S. PATENT DOCUMENTS

| | | | | |
|---|---|---|---|---|
| 1,322,576 | A * | 11/1919 | Jansinski et al. | 114/240 R |
| 2,052,774 | A * | 9/1936 | Kundert | 256/32 |
| 2,395,056 | A * | 2/1946 | Luby | 114/240 R |
| RE30,814 | E | 12/1981 | Mainiero | |
| 4,738,563 | A | 4/1988 | Clark | |
| 4,906,975 | A | 3/1990 | Casella et al. | |
| 5,007,619 | A | 4/1991 | Sibeni | |
| 5,100,108 | A | 3/1992 | Schultz | |
| 5,401,002 | A | 3/1995 | Major | |
| 5,482,256 | A | 1/1996 | Caron | |
| 5,530,430 | A | 6/1996 | Pavlov | |

(Continued)

FOREIGN PATENT DOCUMENTS

| | | | | |
|---|---|---|---|---|
| GB | 2170239 | A * | 7/1986 | E04H 17/02 |
| GB | 2376026 | A * | 12/2002 | E04H 17/02 |

OTHER PUBLICATIONS

ICC, Electric fence for ships steps up fight against pirates, News Release, Jan. 23, 2003, London.

Secure Marine, Ship security, Brochure, 2002.

*Primary Examiner* — Ajay Vasudeva

(74) *Attorney, Agent, or Firm* — Duane Morris LLP

(57) ABSTRACT

The invention is directed to a security barrier for preventing trespass onto a water vessel. The security barrier includes one or more modular frame members, a strand of razor wire attached to the frame member and a suspension fastener for removably suspending the security barrier from a mounting surface of a water vessel.

20 Claims, 19 Drawing Sheets

(56) References Cited

U.S. PATENT DOCUMENTS

| | | | |
|---|---|---|---|
| 6,036,175 | A | 3/2000 | Harper |
| 6,068,243 | A | 5/2000 | Hoggan |
| 6,712,339 | B1 | 3/2004 | Smith |
| 6,926,262 | B1 | 8/2005 | Pavlov |
| 7,165,760 | B2 | 1/2007 | Campbell |
| 7,377,490 | B1 | 5/2008 | Khosravian |
| 7,419,139 | B2 | 9/2008 | Pavlov |
| 2003/0183814 | A1 | 10/2003 | Marsh |
| 2008/0083915 | A1 | 4/2008 | Trascher |
| 2008/0217596 | A1 | 9/2008 | Dolan |
| 2009/0032790 | A1 | 2/2009 | Timms |
| 2009/0050862 | A1 | 2/2009 | Cruce |
| 2009/0100997 | A1 | 4/2009 | Fuqua |
| 2009/0179758 | A1 | 7/2009 | Squier |

* cited by examiner

SECURITY BARRIER

BACKGROUND OF THE INVENTION

1. Related Applications

This application is a non-provisional of and claims priority to U.S. provisional patent application No. 61/381,788, filed on, Sep. 10, 2010, pursuant to 35 U.S.C. §119(e), herein incorporated by reference in its entirety.

2. Field of the Invention

The present invention relates to the field of water vessel defense systems, particularly security bather systems for preventing unauthorized boarding of a water vessel by pirates, terrorists, thieves and other trespassers.

3. Description of the Related Technology

Attack by pirates and thieves is a serious problem for ships transiting international waterways. Current ship defense technologies are focused on weapon systems, devices for identifying and tracking the location of potential combatants or propulsion systems for out maneuvering or out running a potential threat. Little effort, however, has been made to develop bather systems that deter or prevent trespass onto a water vessel. Although passive self-defense systems, such as the use of razor wire or electric fencing on water vessels, have been used in the past, these simple deterrents are inadequate and can be easily overcome.

For example, it is not uncommon for razor wire to be strung along the railing of a ship to provide both a passive physical defense as well as a visual deterrent. The use of razor wire in this fashion, however, has limited effectiveness as the bather is limited to the railing. Additionally, razor wire is difficult and dangerous to handle. Consequently, it can be unwieldy and difficult to install, particularly given the tedious and time consuming step of attaching the razor wire every few feet along the railing. Moreover, razor wire, which comes in large rolls, is typically installed in uninterrupted runs. Consequently, a grapple hook may be used to pull down long sections of the wire all at once in order to breach this defense.

Furthermore, because the razor wire can pose a safety hazard to passing crew members and passengers on the ship, it usually needs to be removed once the ship is out of harm's way. Removal and storage, however, are painstaking and dangerous tasks. Consequently, many crews choose not to reuse razor wire; instead, they simply cut the razor wire from the side of the ship after a single use, letting it fall into the water.

The effectiveness of other passive defense systems, such as the Secure-Marine™ electric fence, which protrudes out horizontally from the sides of a ship, is also limited. Again, by positioning the electric fence on the railing, protection is only provided along the railing and can be easily overcome by severing the electrical wires. Furthermore, the electrical fence is designed to be a permanent feature of the ship, which can be difficult to maintain and repair and does not allow for the option of removing and/or reusing the electrical fence on another vessel.

Therefore, there exists a need for an improved defense system that addresses the limitations of the prior art. Specifically, there exists a need for an improved security barrier system that allows for simple and safe deployment, removal, storage and redeployment of razor wire aboard water vessels.

SUMMARY OF THE INVENTION

The invention is directed to security barrier systems for preventing trespass onto a water vessel. In a first aspect, the security barrier system includes a first frame member having a flexible wire body and a plurality of slats attached to the flexible wire body. The first frame member further includes a first strand of razor wire attached to the flexible wire body, wherein the first frame member is adapted to wrap around the first strand of razor wire so as to substantially enclose the razor wire within the first frame member when the first frame member is oriented in a storage orientation. A suspension fastener is attached to an upper portion of the first frame member having a configuration adapted to suspend the first frame member from and removably attach the first frame member to a surface of a water vessel.

In a second aspect, the invention is directed to a security barrier system for a water vessel. The system includes a water vessel having a mounting surface and a security barrier suspended from the mounting surface. The security barrier includes a frame member having a flexible wire body and a plurality of slats attached to the flexible wire body. The security barrier further includes a strand of razor wire attached to the flexible wire body. A suspension fastener is attached to an upper end of the frame member and adapted to suspend the frame member from the mounting surface of the water vessel.

In a third aspect, the invention is directed to a method for using a security barrier on a water vessel. The method involves attaching and suspending a security barrier from a mounting surface of the water vessel. The security barrier includes a first frame member having a flexible wire body and a plurality of slats attached to the flexible wire body. The security barrier further includes a strand of razor wire attached to the first frame member and a suspension fastener that is used to attach and suspend the first frame member to the mounting surface of the water vessel. The method further involves wrapping the first frame member around the first strand of razor wire so as to substantially enclose the razor wire within the first frame member for storage when the security barrier is not in use.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 5(*b*) is a cross-sectional view of the razor wire shown in FIG. 5(*a*).

FIG. 8(*b*) is a side view of a portion of a razor wire strand including a breakaway means configured as a collar connected to separate razor wire portions.

FIG. 18(*b*) is a schematic diagram showing an exemplary means for rolling-up the security barrier, wherein the security barrier oriented in a partly rolled-up position.

FIG. 18(*c*) is a schematic diagram showing an exemplary means for rolling-up the security barrier, wherein the security barrier is oriented in a fully rolled-up position.

DETAILED DESCRIPTION OF THE PREFERRED EMBODIMENT(S)

Figure 1:
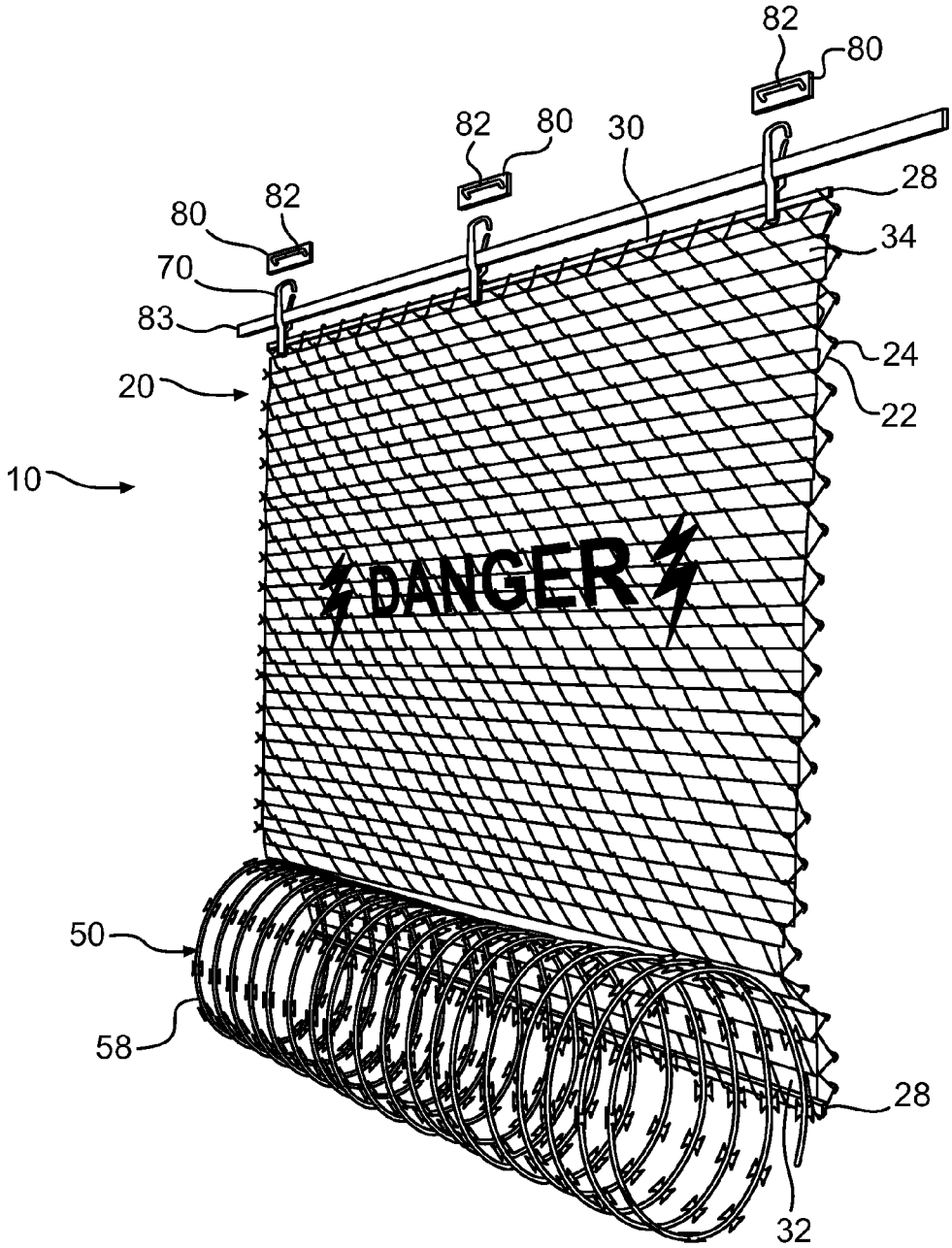
FIG. 1 is one embodiment of the security barrier.

For illustrative purposes, the principles of the present invention are described by referencing various exemplary embodiments thereof. Although certain embodiments of the invention are specifically described herein, one of ordinary skill in the art will readily recognize that the same principles are equally applicable to, and can be employed in other apparatuses and methods. Before explaining the disclosed embodiments of the present invention in detail, it is to be understood that the invention is not limited in its application to the details of any particular embodiment shown. The terminology used herein is for the purpose of description and not of limitation. Further, although certain methods are described with reference to certain steps that are presented herein in certain order, in many instances, these steps can be performed in any order as may be appreciated by one skilled in the art, and the methods are not limited to the particular arrangement of steps disclosed herein.

It must be noted that as used herein and in the appended claims, the singular forms "a", "an", and "the" include plural references unless the context clearly dictates otherwise. Furthermore, the terms "a" (or "an"), "one or more" and "at least one" can be used interchangeably herein. The terms "comprising", "including", "having" and "constructed from" can also be used interchangeably.

Furthermore, unless otherwise defined, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described.

For purposes of the present invention, the term "abrasive elements," as used herein, may include any abrasive structure designed to cut, scrape or otherwise abrade. Exemplary abrasive elements include, but are not limited to, protrusions, teeth, serrations, ridges, barbs, spikes, hooks, rasps, graters or any combination thereof.

As used herein, the term, "razor wire" may include any abrasive wire or tape, including but not limited to barbed wire as well as reinforced razor wire tape. In an exemplary embodiment, the razor wire may have a plurality of abrasive elements to deter trespassing.

As used herein, the term, "water vessel" may include any watercraft used for transportation, such as but not limited to, boats, ships, barges and submarines. Exemplary water vessels may include motorized watercrafts for transporting cargo or individuals, such as ocean liners and military ships.

The present invention is directed to a novel security barrier system and method for using the system to prevent trespass onto a water vessel. The technology may be predicated upon the importance of providing a water vessel security barrier system that: incorporates structures, such as razor wire, for deterring or preventing trespass onto a water vessel; enables safe and easy installment, removal, relocation, adjustment and storage of the security barrier system; and incorporates a means to prevent others from removing or disabling the security barrier system. Referring now to the drawings, wherein like reference numerals designate corresponding structure throughout the views, and referring in particular to FIG. 1, the security barrier system 10 of the present invention is designed to deter and prevent trespass onto a water vessel. As shown, security barrier system 10 includes one or more frame members 20 removably mounted to a structure, such as a water vessel. Preferably, security barrier system 10 is configured as a modular assembly including a plurality of removably interconnected frame members 20, each of which may be independently movable relative to and attached to a surface of the water vessel. Each frame member 20 includes one or more strands of razor wire 50 for deterring trespasser and one or more suspension fasteners 70 for suspending frame member 20 from a mounting surface 80 of a water vessel. In an exemplary embodiment, security barrier system 10 may be configured as a grapple resistant, modular system for mounting razor wire 50, that is simple and safe to deploy, remove, store and reuse.

Security barrier system 10 includes one or more modular frame members 20 suitable for supporting and mounting razor wire 50. Frame member 20 has a flexible wire body having any configuration, shape, size and dimension suitable for supporting razor wire 50. Preferably, the body of frame member 20 is shaped and sufficiently sized to completely cover and wrap around the strands of razor wire 50 mounted to frame member 20. For example, in one embodiment, frame member 20 may have a rectangular configuration with a height of at least about the circumference of a coiled strand of razor wire 50 mounted thereto and a width of at least about the width of a coiled strand of mounted razor wire 50, such that frame member 20 has a sufficient dimension to completely wrap around the coiled strand of razor wire 50. When the coiled strand of razor wire 50 is constructed from a plurality of loops 58 of different sizes, frame member 20 has a height of at least about the circumference of the largest loop 58 of the mounted coiled strand of razor wire 50 and a width of at least about the largest width of a coiled strand of mounted razor wire 50.

Figure 2:
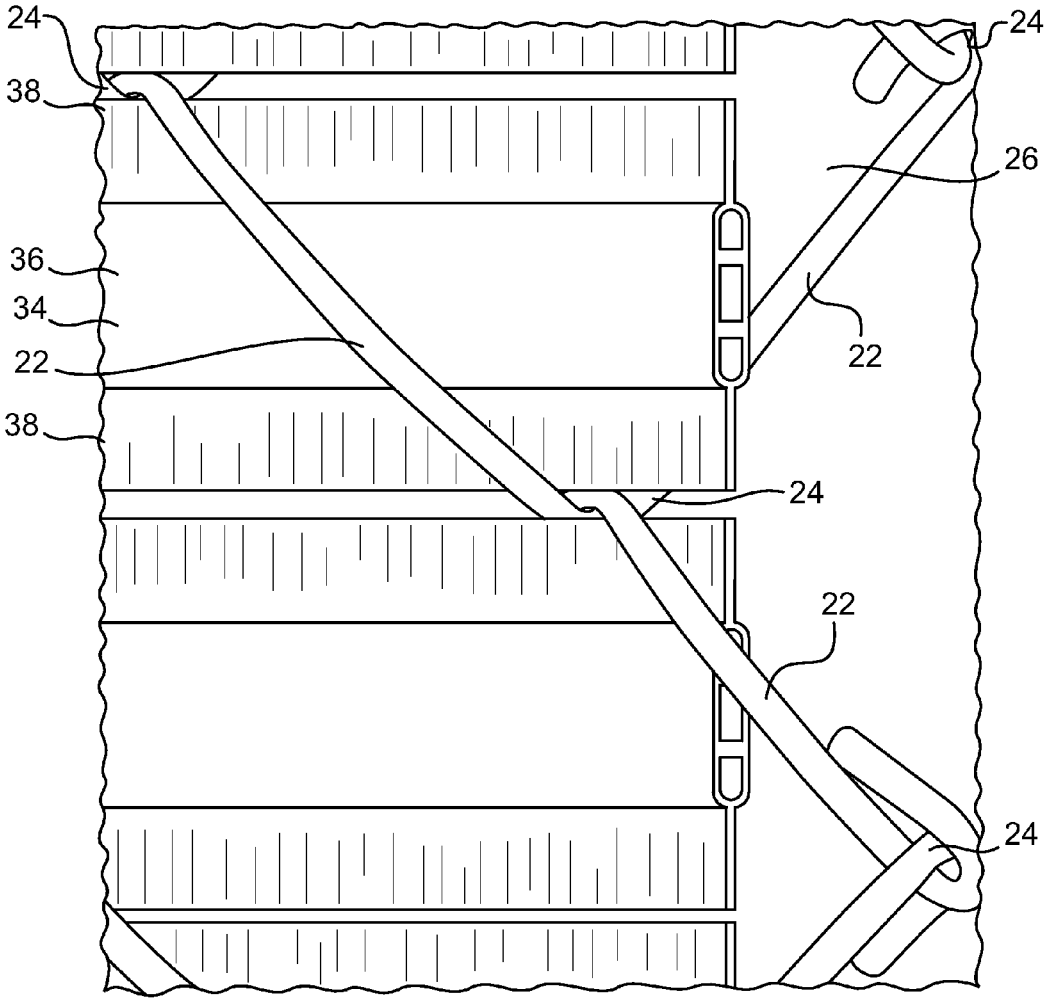
FIG. 2 is a perspective view of a portion of the frame member of FIG. 1 showing slats positioned through the chain linked body of the frame member.

In one embodiment, shown in FIGS. 1-2, frame member 20 is configured as a rectangular flexible chain linked fence body constructed from a plurality of diagonally oriented fence wires 22 that interlock with one another to form a plurality of flexible links 24. The interlocked fence wires 22 can form a plurality of rectangular, square or diamond shaped segments 26 consistent with conventional chain linked fence construction, best shown in FIG. 9.

One or more elongated tension bars 28 may be horizontally attached to an upper end 30 and/or lower end 32 of frame member 20, reinforcing and providing rigidity to frame member 20. Lower tension bar 28, in particular, functions to maintain frame member 20 in an extended, deployed orientation. Preferably tension bar 28 is woven through, positioned through or integrally formed along frame member 20. For example, tension bar 28 can be woven through segments 26 positioned along an upper end 30 and lower end 32 of frame member 20. Alternatively, tension bar 28 may be spaced apart from and attached to upper frame member end 30 using an attachment means, such as clamps, clips, snaps, or other conventional attachment means.

Figure 9:
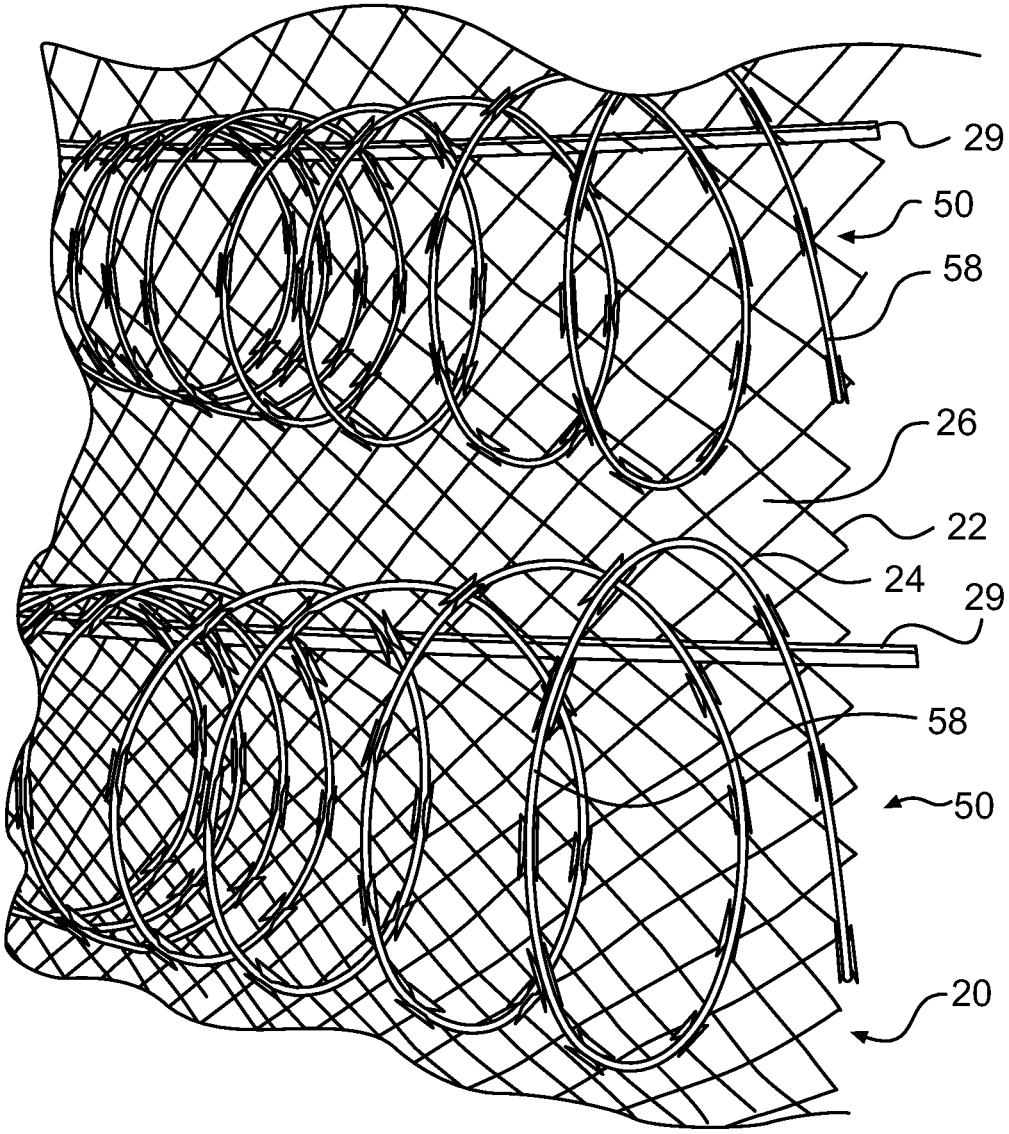
FIG. 9 is a perspective view of two coiled strands of razor wire attached to the frame member and vertically spaced apart from one another.

Optionally, a plurality of poles 29 may be attached to, so as to be woven through, positioned through or otherwise connected to fence member 20, wherein poles 29 are intermittently positioned along the length of frame member 20, as shown in FIG. 9. Poles 29 may be positioned and arranged so as to facilitate the process of rolling-up and storing frame member 20 for later use.

In an exemplary embodiment, frame member 20 is constructed from a roll of flexible 9 gauge, knuckle ended, chain link fence, wherein fence wires 22 have a diameter of about 0.148 inches that is constructed from vinyl coated, hot-dip galvanized steel. In this embodiment, frame member 20 has a rectangular configuration with a height of about 5 ft, a width of about 6 ft and a 2 inch mesh of segments 26. The chain link fence further includes a pair of vinyl coated galvanized steel tension bars 28, each about ¾ inch wide, that are attached to and positioned along the upper and lower frame member end 30, 32.

As shown in FIG. 2, a plurality of flexible, elongated slats 34 are horizontally woven through segments 26, such that slats 34 are oriented parallel to tension bar 28 and poles 29. Slats 34 can be friction fitted and restrained within segments 26 so as to be automatically secured and locked into place. By positioning and/or weaving slats 34 through the chain linked frame member 20, slats 34 minimize openings in the chain linked fence that may provide a surface on which a grapple hook may be anchored, rendering frame member 20 grapple resistant. Slats 34 also remove hand and foot hole openings in the chain-linked fence to inhibit and prevent a trespasser from scaling security barrier system 10. Slats 34 can have any shape, size or configuration suitable for forming a backing or protective surface of frame member 20. In the embodiment shown in FIG. 2, slat 34 is configured as an elongated, flexible member 36, wherein two flexible, wing segments 38 are attached along the length of member 36 on opposite sides of member 36. Slats 34 may be constructed from any suitable material, including metals or plastics, such as polyvinyl chloride (PVC). When inserted within frame member 20, slats 34 form a substantially continuous yet flexible backing surface, allowing frame member 20 to be rolled-up in a direction perpendicular to the length of slats 34. Optionally, as shown in FIG. 1, words and/or images may be printed on the substantially continuous backing surface. Preferably, warning messages may be printed on the backing surface to notify individuals of the presence of security barrier system 10 and to function as a visual deterrent to trespassers.

Figure 3:
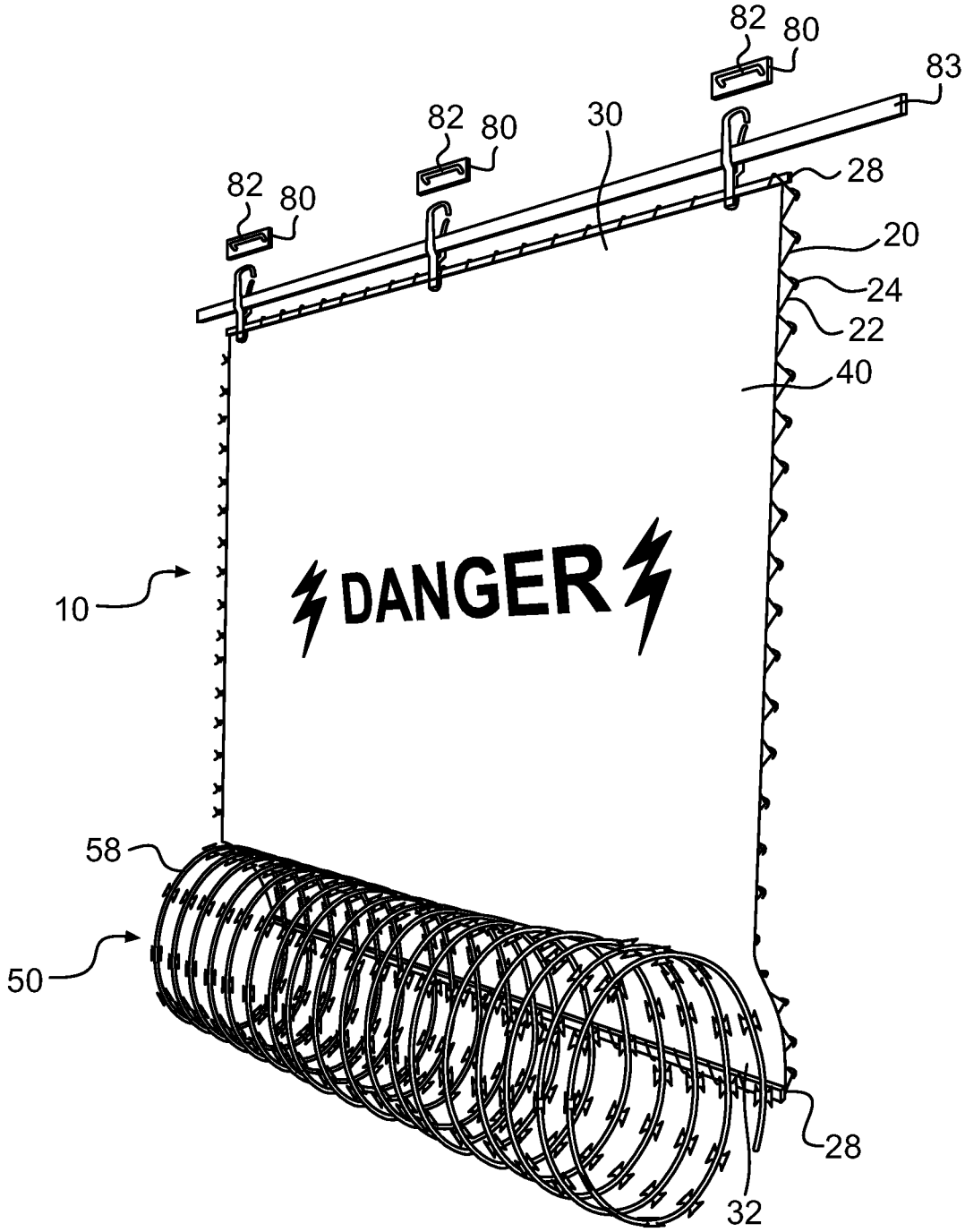
FIG. 3 is another embodiment of the security barrier showing a fabric screen attached to the frame member.

In an alternative embodiment shown in FIG. 3, slats 34 may be replaced with a fabric screen 40 that is attached to and covers frame member 20. Alternatively, both slats 34 and fabric screen 40 may be attached to frame member 20. Fabric screen 40 may be constructed from any suitable durable material for forming a substantially continuous backing surface. Exemplary materials include vinyl coated polyester fabric. Preferably, fabric screen 40 may be configured as a durable, breathable and reinforced fabric screen constructed from one or more, preferably two or more layers of fabric. The edges of fabric screen 40 may be reinforced and attached to tension bars 28 or other portions of frame member 20 using any conventional fastening means. Additionally, a plurality of grommets may be positioned along one or more edges of fabric screen 40, providing another surface for coupling suspension fastener 70 to frame members 20. Similar to the embodiment of FIG. 1, the fabric screen covered frame member 20 is an ideal surface for printing warning messages and also allows for the easy installation, storage and removal of security barrier system 10.

Figure 4:
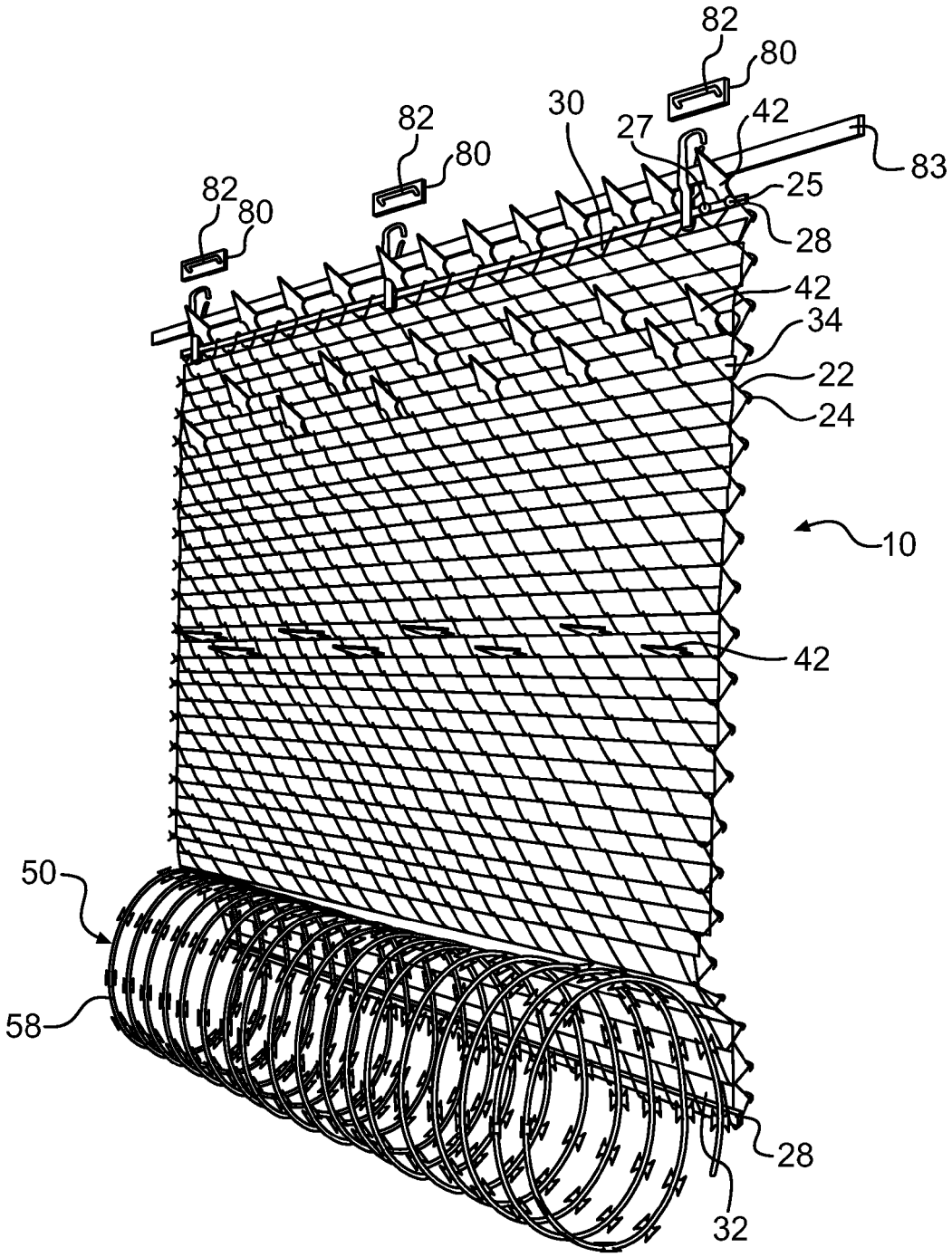
FIG. 4 is another exemplary embodiment of the security barrier showing spikes integrally attached to the frame member, power source for electrifying the frame member and a proximity sensor.

Frame member 20 may further include one or more optional features that functions as an additional barrier structure, visual deterrent or otherwise enhances the effectiveness of security barrier system 10. For example, in one embodiment, frame member 20 may include a plurality of abrasive elements 42 positioned along any exposed outer surface of frame member 20, facing away from a water vessel on which frame member 20 is mounted. Preferably abrasive elements 42 are spikes having any suitable configuration having one or more edges or tapered points that deter contact with frame member 20. Preferably, the spike has a pyramidal configuration with substantially smooth side faces that taper to an apex. These substantially smooth side faces preferably do not have edges that catch on a loop 58 of razor wire 50 or otherwise inhibit the rolling, unrolling or mounting of frame member 20. Abrasive elements 42 may be attached to frame member 20 in any conventional manner. Preferably, abrasive elements 42 are integrally formed with and along a potion of frame member 20. For example, a plurality of spikes shown in FIG. 4, are integrally formed along frame member upper end 30 and along the body of frame member 22. Additionally, these spikes can be attached to frame member lower end 32, tension bar 28, poles 29 or any other surface of frame member 20. Smaller spikes, preferably having a length of about 18 in or less, may be periodically or intermittently attached to frame member 20 using wire fasteners or other conventional attachment means.

In another embodiment, each frame member 20 may optionally be electrified as a further trespass deterrent. In one embodiment, each frame member 20 of security barrier system 10 may have its own power source, preferably a renewable power source 25, such as a solar cell or a mechanoelectric generator/transducer that provides a voltage to electrify frame member 20. Two or more frame members 20 can also be electrically connected in such a manner that the removal of one frame member 20 would not disable the electrical conduction of adjacent frame members 20.

In another embodiment, each frame members 20 may optionally include a proximity sensor 27 that functions to determine the position of a potential trespasser as well as determine whether any frame members 20 of security barrier system 10 has been compromised.

Figure 19:
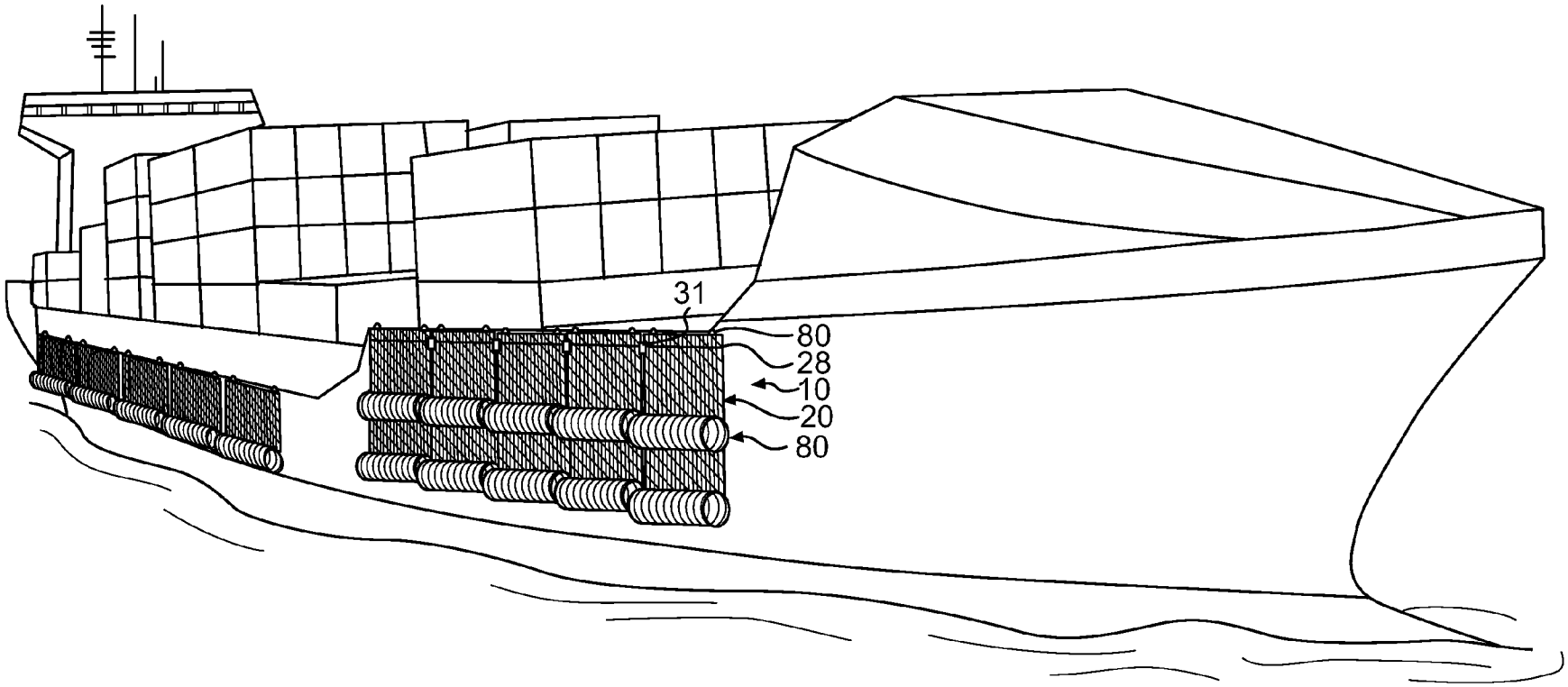
FIG. 19 is a perspective view showing the security barrier mounted to a water vessel.

One or more frame members 20 can be integral or removably connected to one another in order to form a modular security barrier system 10. The frame members 20 can be attached using a connector 31, such as snap hooks, that connect the tension bars 28, poles 29 or other structures of two adjoining frame members. For example, snap hooks may be used to connect a bottom tension bar 28 of one frame member 20 with an upper tension bar 28 of an adjacent frame member 20. FIG. 19 shows the tension bars 28 of multiple frame members 20 attached to one another via connectors 31. In one embodiment, a plurality of interconnected modular frame members 20 can be attached to and positioned along the length and width of the railing, bulwark, hull or other exterior surface of a water vessel. Each module may independently move and sway with the motion of the water vessel. In addition to being independently movable relative to one another, each frame member 20 can be independently attached to a surface of a water vessel. By virtue of this modular construction, security barrier system 10 is not easily torn from a water vessel. Therefore, when a grapple hook is used to latch onto and remove a frame member 20 of security barrier system 10, the surrounding frame members 20 would remain secured to the water vessel.

Figure 5A:
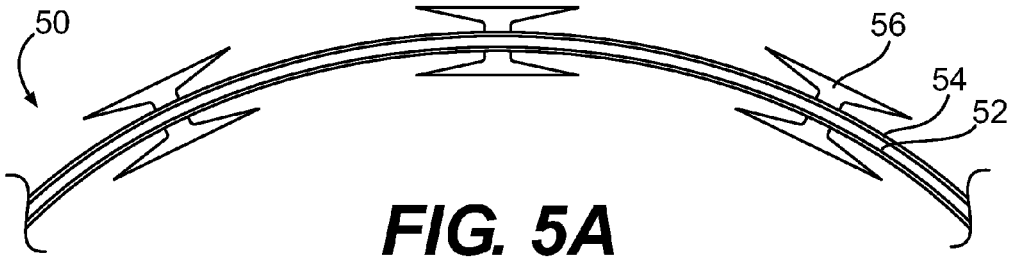
FIG. 5(*a*) is a side view of a portion of the razor wire shown in FIG. 1.
Figure 5B:
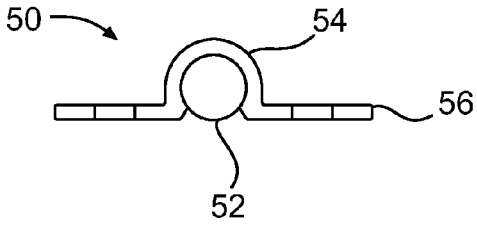

Frame member 20 further includes one or more strands of razor wires 50 that are attached to, supported by and arranged on the body of frame member 20 so as to deter trespassing. As best shown in FIGS. 5(*a*)-5(*b*), razor wire 50 is constructed from a spring tempered wire core 52 reinforced with and surrounded by an outer tape 54 having a plurality of intermittently positioned barbs 56. In an exemplary embodiment, razor wire 50 has a diameter of about 0.0047 inches or about 0.098 inches and is constructed from a spring tempered wire core 52, preferably made of 18 gauge galvanized stainless steel, reinforced with a stainless steel tape 54 having intermittently spaced barbs 56 that are about 2¼ inches in length.

Figure 6:
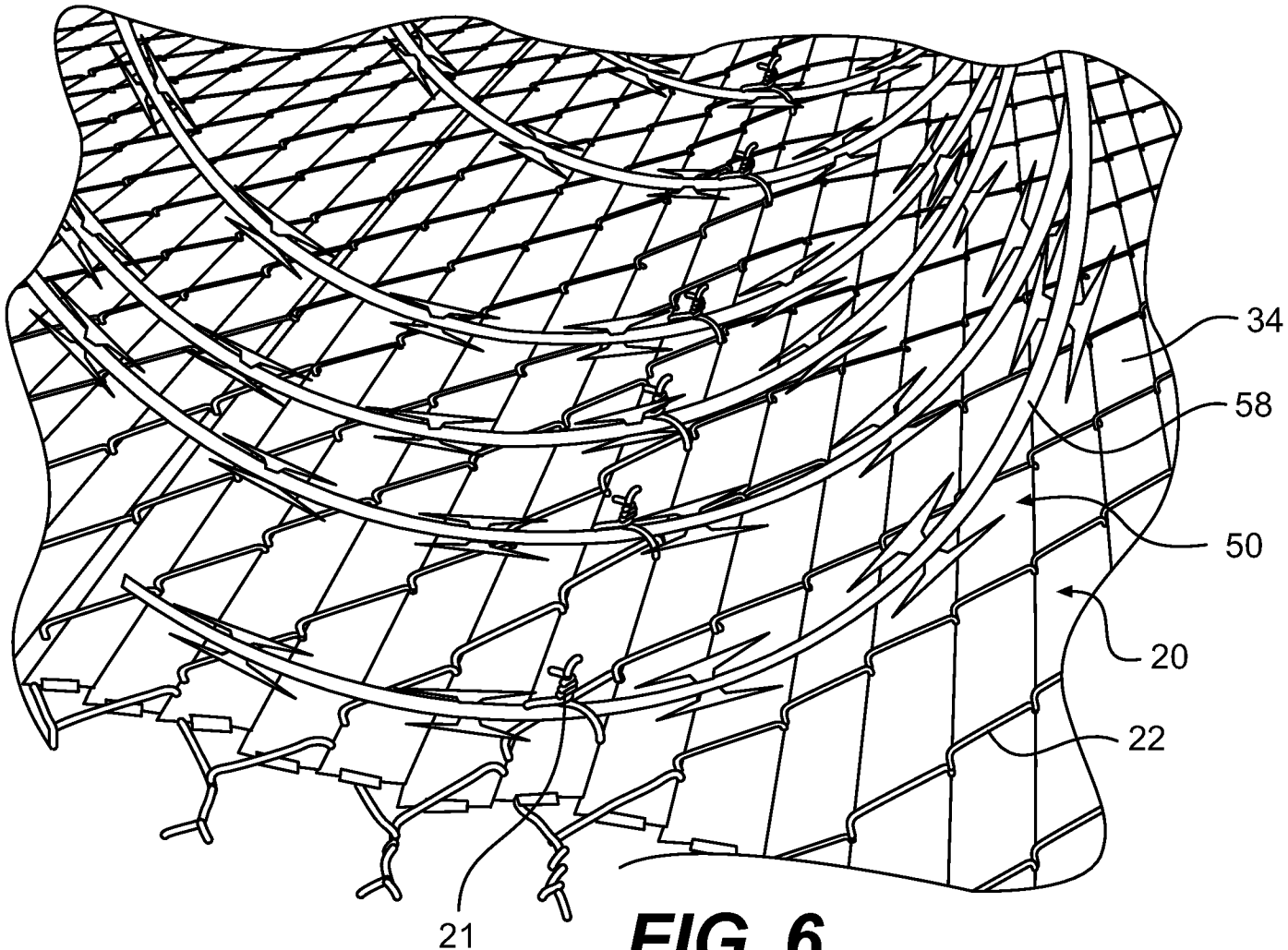
FIG. 6 is a perspective view of a portion of a coiled strand of razor wire attached to the frame member with wire fasteners.
Figure 7:
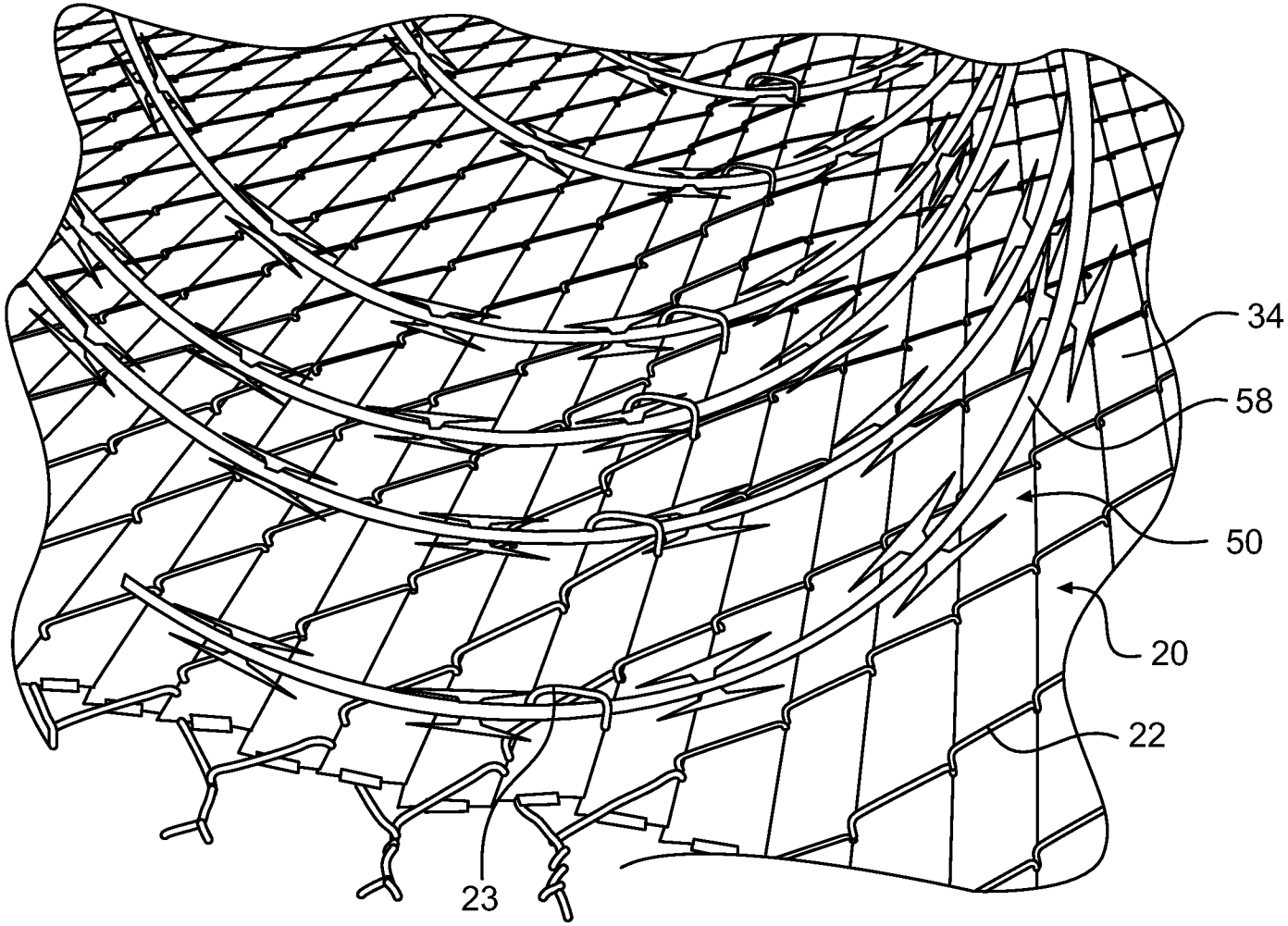
FIG. 7 is a perspective view of a portion of a coiled strand of razor wire attached to the frame member using hog ties.

Razor wire 50 can be secured to frame member 20 at one or more locations along frame member 20 using any suitable means. In one embodiment, razor wires 50 may be tied to the interlinked fence wires 22 of frame member 20 using wire fasteners 21, shown in FIG. 6, hog rings 23 shown in FIG. 7, or similar fasteners. The wire fasteners 21 of FIG. 6 encircle a portion of razor wire 50 and a portion of frame member 20, preferably wrapping around one or more fence wires 22 and slats 34; the ends of wire fasteners 21 are subsequently twisted together, forming a wire twist, to secure razor wire 50 to frame member 20. Similarly in FIG. 7, hog rings 23 clamp around and attach a portion of razor wire 50 and a portion of frame member 20 to one another. Preferably, razor wire 50 is attached to frame member 20 using a stainless steel double loop 18 gauge tie wire having a diameter of about 0.47 inches.

Each strand of razor wire 50 optionally includes one or more sections designed to break away from adjoining sections of the razor wire 50 upon sufficient application of force. This may be accomplished by including one or more breakaway means 51 intermittently positioned along each strand of razor wire 50. This breakaway design prevents an entire strand of razor wire 50 from being torn from frame member 20 when one or more sections of razor wire 50 becomes inadvertently caught on a passing structure or forcibly removed by a grappling hook. When one or more sections of razor wire 50 is thus torn from frame member 20, the adjoining sections of razor wire 50 are designed to substantially return to their initial configuration by virtue of the memory and spring properties of razor wire 50. For example, when a section of a coiled strand of razor wire 50 having a plurality of intermittent breakaway means 51 is torn from frame member 20, the adjoining sections of razor wire 50 are extended and stretched but spring back to reassume their initial coiled configuration.

Figure 8A:
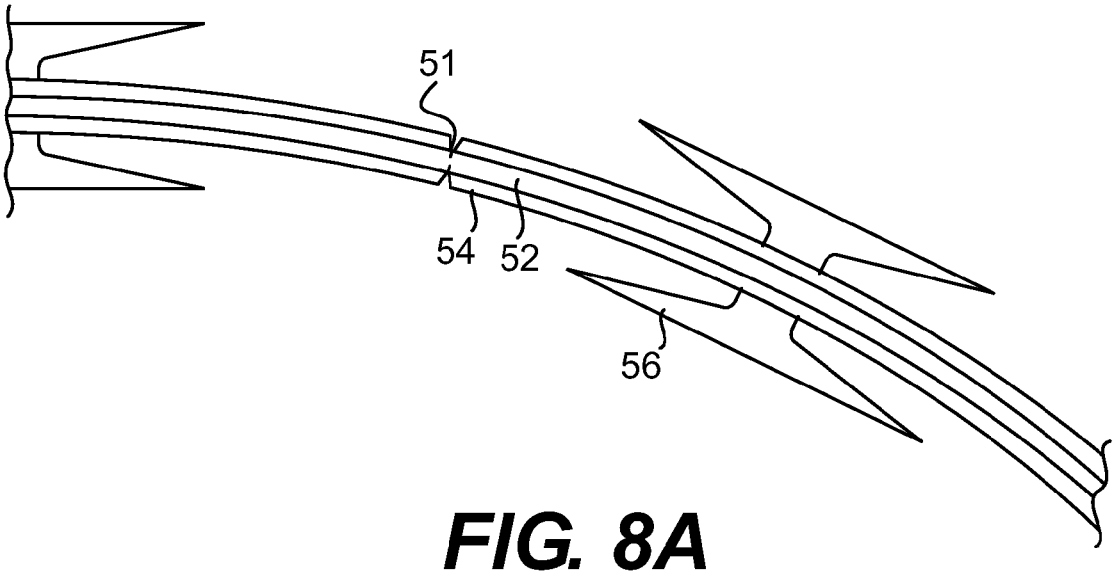
FIG. 8(*a*) is a side view of a portion of a razor wire strand including a breakaway means configured as a score line.
Figure 8B:
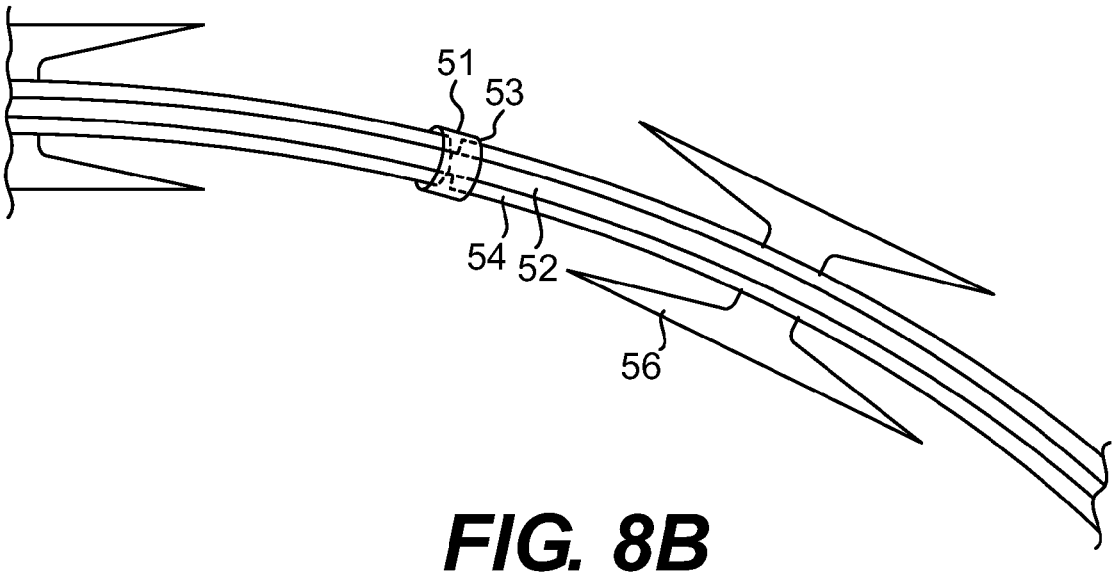

In one embodiment shown in FIG. 8(*a*), the breakaway means 51 is a score line designed to allow a section of razor wire 50 to tear away from adjoining sections of the razor wire 50 upon application of sufficient force. The scored razor wire 50 may be a cut or weakened section of the strand of razor wire 50 having compromised integrity that is intended to induce breakage at the score line. In an exemplary embodiment, razor wire 50 is cut partly through the spring tempered wire core 52 to create the score line. The cut is calibrated to allow a section of razor wire 50 to break away upon the application of sufficient force, preferably a force of about 200 to about 300 lbs or the force generally imparted by a grapple hook pulled by a speedboat.

Alternatively, as shown in FIG. 8(*b*), breakaway means 51 may be configured as a razor wire 50 that is cut into two separate sections which are held together by a sleeve 53. Exemplary sleeves 53 used to connect the severed ends of razor wire 50 include a metal collar or a quick connect mechanism. The connection between the cut ends of razor wire 50 and the sleeve 53 may be designed and calibrated to break away upon sufficient application of force such that one or both ends of the cut razor wire 50 becomes separated from sleeve 53.

In the exemplary embodiment of FIG. 1, razor wire 50 may be configured as a three-dimensional coiled structure that is preferably horizontally mounted to frame member 20 such that it is oriented parallel to an upper and lower end 30, 32 of frame member 20. The coiled strand of razor wire 50 is also preferably oriented parallel to tension bars 28 and poles 29. As shown, a strand of razor wire 50 is arranged in a series of loops 58 that form a cylindrical coiled configuration. Razor wire 50 can be tied to frame member 20 at one or more locations where loop 58 contacts or is adjacent to frame member 20. Optionally, each loop 58 may include one or more breakaway means 51. In an exemplary embodiment, each strand of the coiled razor wire is about 75 ft in length when fully extended and about 6 ft in length when coiled. The coiled strand of razor wire 50 preferably has about 3 or more loops 58 per foot, totaling about 16 to about 18 loops 58 per strand. Each loop 58 is preferably about 18 inches in diameter.

One or more coiled strands of razor wire 50 may be attached to and positioned on any portion of frame member 20. Preferably, two or more separate strands of razor wire 50 may be arranged horizontally adjacent to one another, end to end. By virtue of separately attaching two or more strands of razor wire 50 to frame member 20, should one strand of razor wire 50 be torn from frame 20, the adjacent strand of razor wire 50 would remain secured to frame 20. When not in use, frame member 20 may be wrapped around the strands of razor wire 50, allowing for compact storage and safe handling of razor wire 50.

In one embodiment shown in FIG. 9, two or more coiled strands of razor wire 50 may be attached to frame member 20 so as to be vertically spaced apart from one another. The coiled strands of razor wire 50 may be separated by a distance of at least about the circumference of loop 58, such that a portion of frame member 20 adjoining the two coils of razor wire 50 is capable of separately and completely encircled each coiled strand of razor wire 50. In one embodiment, a plurality of coiled strands of razor wire 50 may be vertically spaced apart from one another by intervals of at least about 4 inches.

Figure 10:
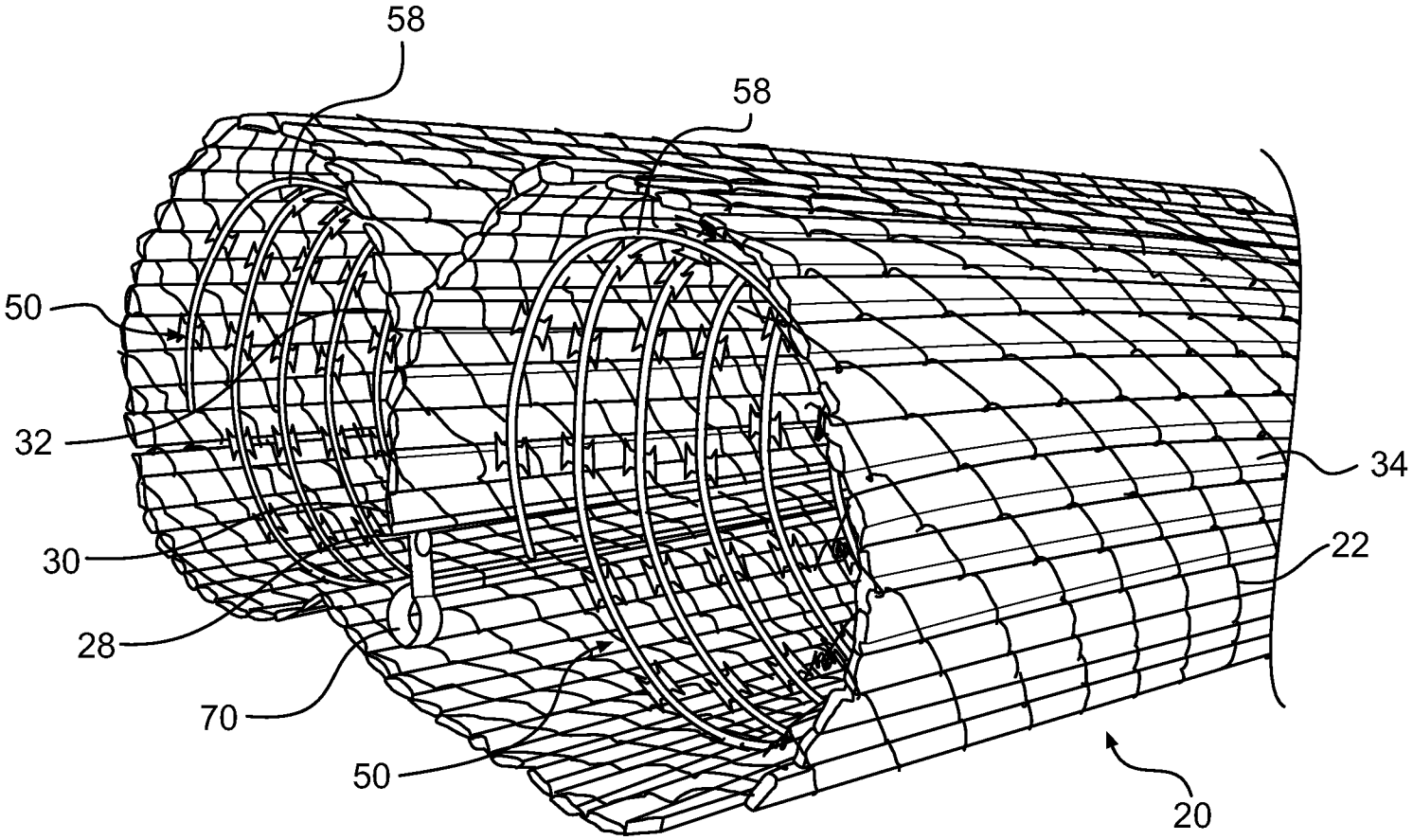
FIG. 10 is a perspective view showing a frame member wrapped around two coiled strands of razor wire attached to the upper end and lower end of the frame member.

In another example, the coiled strands of razor wire 50 may be positioned along the upper end 30 and lower end 32 of frame member 20. In this embodiment, the length of frame member 20 is preferably at least about 2.5 times the circumference of loop 58 to ensure that the two coiled strands of razor wire 50 can be fully enfolded and thereby safely stored and transported within frame member 20. When stored, this embodiment of frame member 20 may be rolled-up like a scroll, as shown in FIG. 10.

Figure 11:
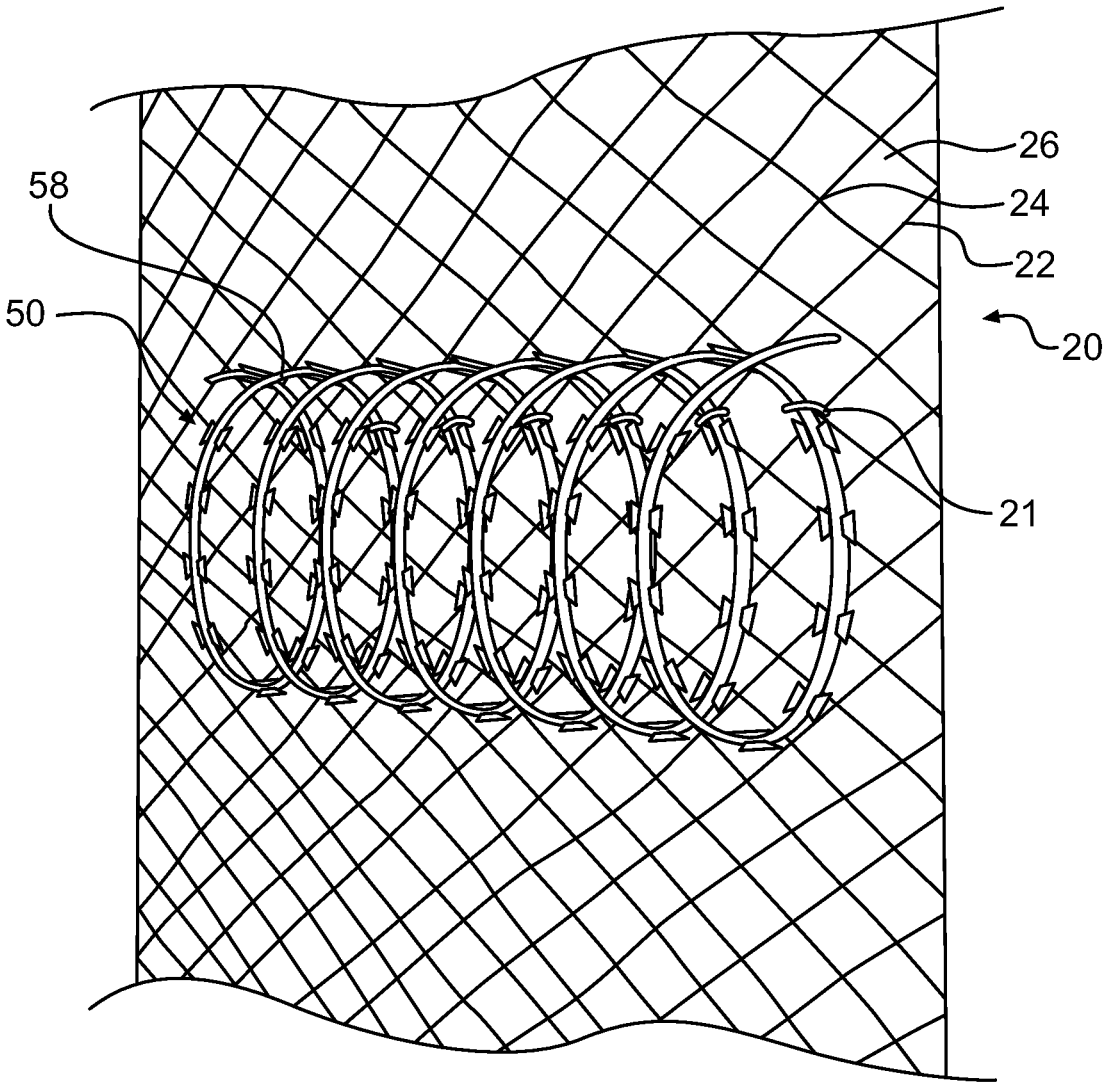
FIG. 11 is a perspective view of an exemplary razor wire configured as a flat two-dimensional coiled structure.

In yet another embodiment, razor wire 50 may be configured as a two dimensional structure that is secured to one or more locations along frame member 20. As shown in the embodiment of FIG. 11, a coiled strand of razor wire 50 includes a plurality of loops 58 that are arranged so as to lay flat against frame member 20. In this embodiment, the loops 58 of the coiled strand of razor wire 50 are arranged in a planar configuration that is substantially parallel to an upper surface of frame member 20, forming overlapping circles that are positioned flat against and in continuous contact with frame member 20.

Figure 12:
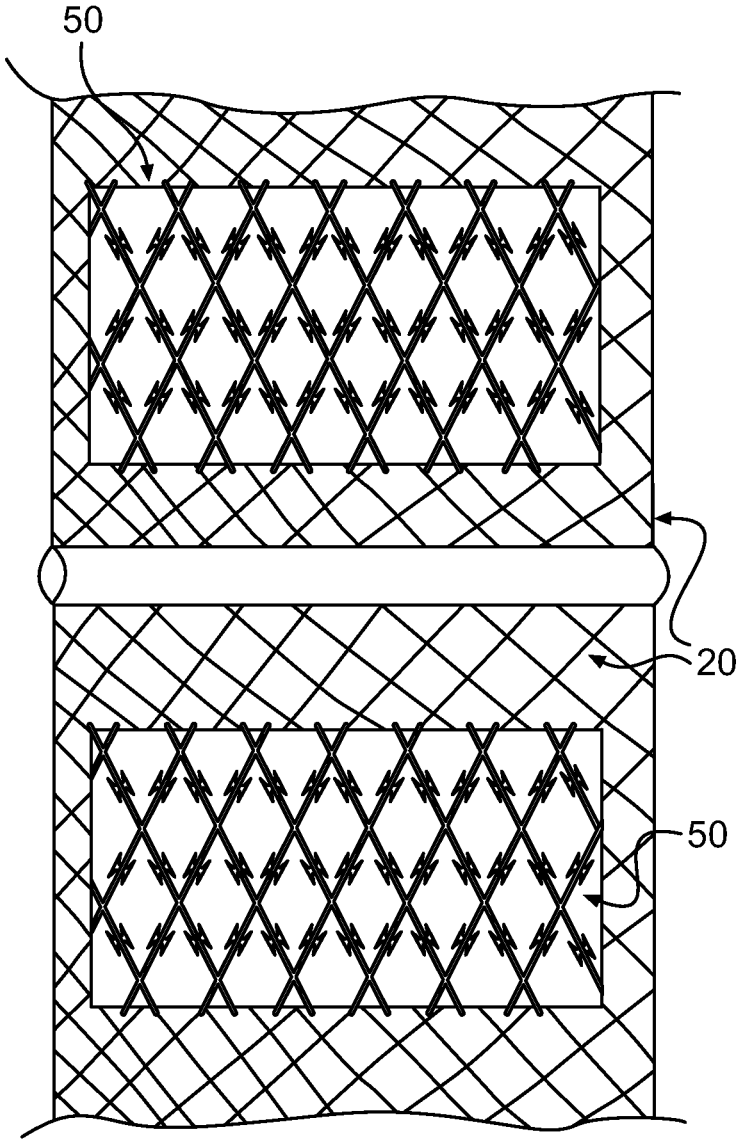
FIG. 12 is a perspective view of an exemplary razor wire configured as a flat two-dimensional mesh structure.

Alternatively, as shown in FIG. 12, a two dimensional, flat wire mesh of razor wires 50, constructed from overlapping planar strands of razor wire 50, may be attached to frame member 20. Two or more linear strands of razor wire 50 oriented parallel to one another may also be attached to frame member 20, so as to be positioned flat against and in continuous contact with frame member 20, wherein the strands are arranged in a planar, non-overlapping configuration.

These two dimensional configuration of razor wire 50 may be rolled-up or folded with frame member 20 for storage. In one embodiment, the two-dimensionally configured razor wire 50 can be rolled-up with frame member 20 for storage. In another embodiment, shown in FIG. 12, frame member 20 includes at least two sections connected by a hinge. The two sections are capable of being folded over one another. Razor wire 50 can be attached to and cover one or both of the folding frame member sections. In one embodiment, a first section of frame member 20 is covered with a flat mesh of razor wire 50 while an adjoining second section is razor wire free. When not in use, the second section of frame member 20 is folded over the first section, allowing for compact storage and safe handling. In general, the overall dimension of the frame member 20 section is preferably at least about twice the size of the area occupied by the razor wire 50 to ensure safe handling.

A plurality of suspension fasteners 70 may be used to couple frame member 20 to one or more surfaces a water vessel, such as the railing, bulwark or hull. Preferably, suspension fastener 70 enables the frame member 20 to be easily, safely and removably attached to a surface of a water vessel. Exemplary suspension fasteners 70 include clamps, clips, latches, snaps, hooks, threaded fasteners or combinations thereof. In the embodiment shown in FIGS. 1 and 13, fastener 12 is configured as a durable and high strength snap hook having a configuration similar to a carabineer having a pivotally articulating gate and adapted to support heavy loads.

One end of suspension fasteners 70 may be integrally or removably connected to any portion of frame member 20, including fence wire 22, tension bar 28 and pole 29. Preferably, two or more suspension fasteners 70, preferably snap hook, capable of bearing a load of about at least 500 lbs, are attached to an upper end of tension bar 28. At least two snap hooks may be positioned at a location between the distal ends and central region of tension bar 28. Preferably snap hooks are positioned at a location about ⅓ of the length of tension bar 28 from the distal ends of tension bar 28. In one embodiment, one or more extension chains or wire ropes may be positioned between suspension fastener 70 and tension bar 28 or other surface of frame member 20. The extension chains or wire rope may be used to lower and adjust the position of frame member 20 relative to suspension fastener 70 and a surface of the water vessel to which suspension fastener 70 is attached. In one embodiment, suspension fastener 70 may be attached to so as to be inserted through, positioned on or clamped to a mounting surface 80, such as a railing, bar, or other fixtures of a water vessel and attached to one or more links of the extension chain, thereby adjusting the position of frame member 20 relative to a surface from which it is hung.

Figure 14:
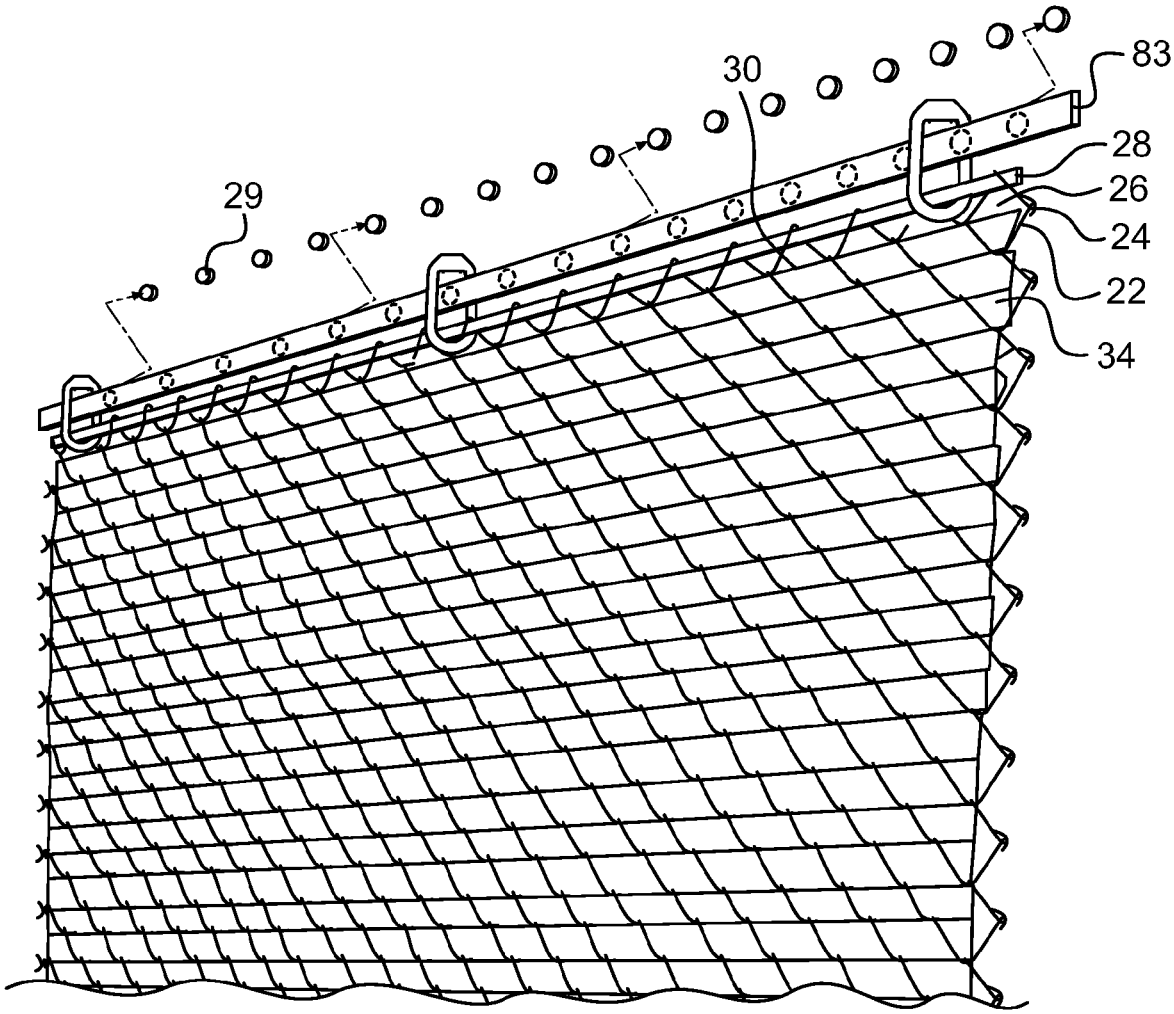
FIG. 14 is a perspective view showing magnets connect a rear surface of the frame member tension bar to facilitate attachment to a water vessel.

Optionally, one or more magnets may be used to enhance the attachment of frame member 20 to a metallic structure, such as the bulwark or hull of a water vessel. A plurality of magnets may be positioned along a rear surface of one or more portions of frame member 20, such as fence wire 22, slat 34, tension bar 28, or pole 29, so as to be adjacent to the surface on which it is to be mounted. The magnets may have any suitable configuration and have sufficient force so as to facilitate retention and positioning of frame member 20. Preferably, each magnet has a minimum pull force of at least about 200 pounds. In one embodiment, two or more cup magnets 29, shown in FIG. 14, may attach railing 83 of a water vessel to a surface of frame member 20, such as tension bar 28, wherein one face of magnets 29 may be attached to railing 83 while an opposing second face is attached to a rear surface of tension bar 28. Magnets 29 may also be attached to other portions of frame member 20, including any portion of its flexible wire body. Preferably, magnets 29 are attached to frame member 20 using wire fasteners and are equidistantly spaced along the bottom of frame member 20 to minimize swaying when frame member 20 is mounted on a water vessel.

The present method is also directed to a method for using security barrier system 10 to deter trespassing. During operation, security barrier system 10 may be removably attached to a mounting surface 80, such as a railing, bar, or other fixtures, of a water vessel. When not in use, security barrier system 10 may be easily and safely rolled-up or folded into a compact configuration for storage. Security barrier system 10 can subsequently be redeployed when desired. It can also be removed and attached to another water vessel. Alternatively, security barrier system 10, can also be removed from a water vessel and mounted to other types of structures, such as buildings.

Figure 13:
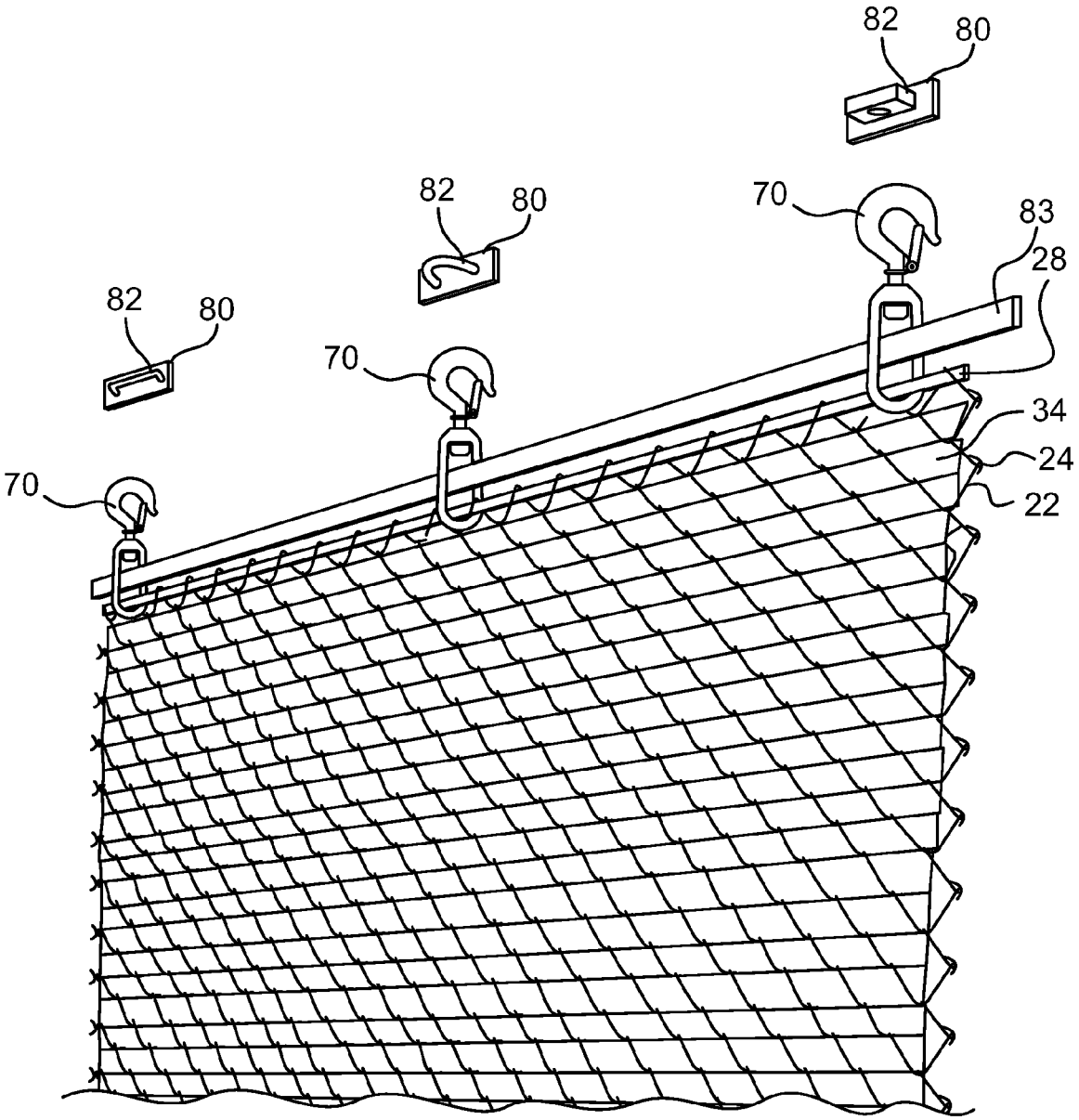
FIG. 13 is a perspective view showing different mounting structures to which the security barrier can be attached.

In an exemplary embodiment, security barrier system 10 may be removably mounted to an exterior side surface water vessel, as shown in FIG. 19. For example, mounting surface 80 may be a railing, bulwark, bar or other fixture on a water vessel. Preferably, frame members 20 of security barrier system 10 can be attached to one or more different pad eye configured mounting surfaces 80, shown in FIG. 13, that is welded to the deck, inner bulwark, outer bulwark or hull of the water vessel. Mounting surface 80 preferably includes a bar 82 around which suspension fastener 70 may be attached. For example, suspension fastener 70 may be clamped, latched, snap fitted onto or otherwise removably attached to bar 82. Preferably, suspension fastener 70 may be a quick connect/release mechanism, such as a snap hook, that facilitates the process of and enables rapid and easy installment as well as detachment of frame members 20. FIG. 13 also illustrates that suspension fasteners 70 can mount frame member 20 to a railing 83 of a water vessel.

In an exemplary embodiment, the distal end of suspension fastener 70 may be connected to frame member 20 by an extension chain or wire rope. Prior to attachment, the length of the extension chain or wire rope may be adjusted to achieve the desired placement of frame member 20 relative to the exterior of the water vessel. In one embodiment, suspension fastener 70 may be threaded through an enclosed space defined by bar 82 and latched onto one or more loops or other intermittently spaced attachment means of the extension chain or wire rope in order to shorten the distance between mounting surface 80 and frame member 20. Frame member 20 can be adjusted to be positioned either along the railing, along the bulwark, below the bulwark, along the hull, above the water level or below the water level.

When security barrier system 10 includes two or more frame members 20, the modular frame members 20 may be coupled to one another prior to installing suspension fastener 70 onto mounting surface 80. In this embodiment, a series of modular frame members 20 maybe simultaneously installed upon attaching the suspension fasteners 70 of the upper most frame member 20 onto mounting surface 80.

Figure 15:
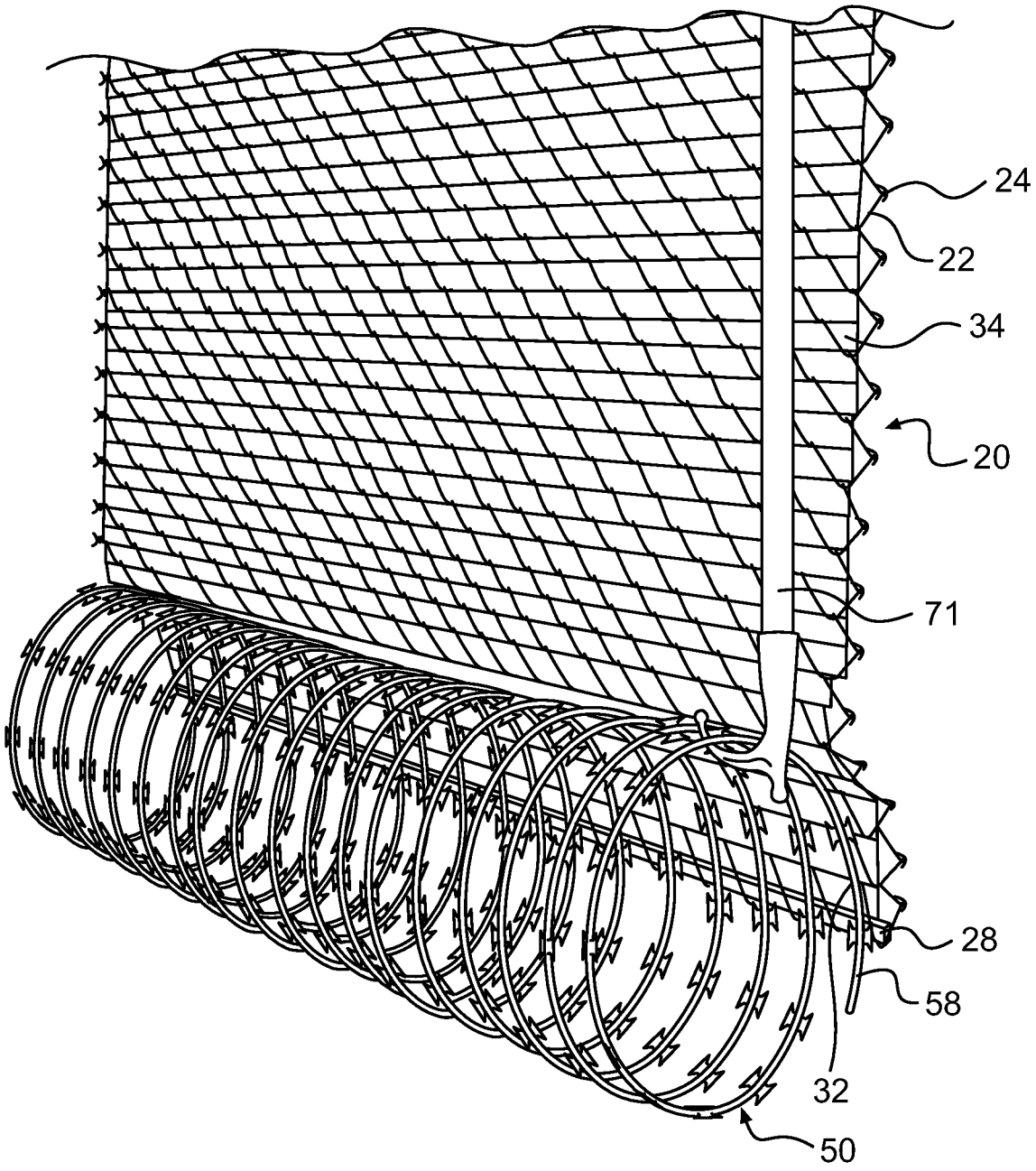
FIG. 15 shows a boat hook used to retrieve a lower end of the security barrier.

When the security barrier system 10 is no longer needed, it can be stored for later use. A common boat hook 71, as shown in FIG. 15, may be used to latch onto and draw up the lower end 32 of frame member 20 or a strand of razor wire 50 positioned at lower end 32 of frame member 20. Lower frame member 32 may be subsequently drawn up around the coiled strand of razor wire 50 so that frame member 20 fully encircles and wraps around the strand of razor wire 50, wherein substantially no surface of razor wire 50 is exposed. The tension bars 28 positioned at opposite ends of frame member 20 may then be connected using snaps or other fasteners integrally formed on the tension bars 28 locking the resultant bundled frame member 20 in a storage configuration. In one embodiment suspension fasteners 70 attached to an upper tension bar 82 may also function to latch onto a portion of frame member 20, such as the lower tension bar, to secure frame member 20 in a rolled-up storage configuration. In this compact, bundled, rolled-up storage configuration, shown in FIG. 16, frame member 20 forms a cylindrical roll, wherein the coiled strand of razor wire 50 is completely enfolded and encircled by frame member 20, rendering security barrier system 10 safe for handling. Slats 34 and/or fabric screen 40 of frame member 20 fully enclose and cover razor wire 50, thereby preventing user contact with razor wire 50; the strands of razor wire 50 are only exposed when security barrier system 10 is deployed. When security barrier system 10 includes two or more of horizontally or vertically interconnected frame members 20, each frame member 20 may be individually rolled-up and separately stored. Alternatively, the frame members 20 may be rolled-up as a single continuous assembly to facilitate the process of bundling and later redeploying security barrier system 10. For example, two vertically attached frame members 20 may be rolled-up in the same manner as discussed above, forming a single cylindrical bundle containing both frame members 20. A fastener may connect a lower end of the first frame member to an upper end of the second frame member in order to secure the security barrier system 10 in a rolled-up, storage configuration. The rolled-up security barrier system 10 is thus safe to handle, compact, light weight and ready for storage. Preferably, the rolled-up frame member 10 and rolled-up security barrier system 10 weighs less than about 40 pounds and has a dimension of about 19 inches by 72 inches. The bundle formed by frame member 20 around the coiled strand of razor wire 50, may remain attached to the water vessel via mounting surface 80 to facilitate later redeployment. When chains and/or wire ropes are used to suspend frame member 20 at various heights relative to a railing or bulwark of a water vessel, the security barrier system 10 may be pulled up partway to prevent being crushed or snagged on a surface during docking.

Figure 16:
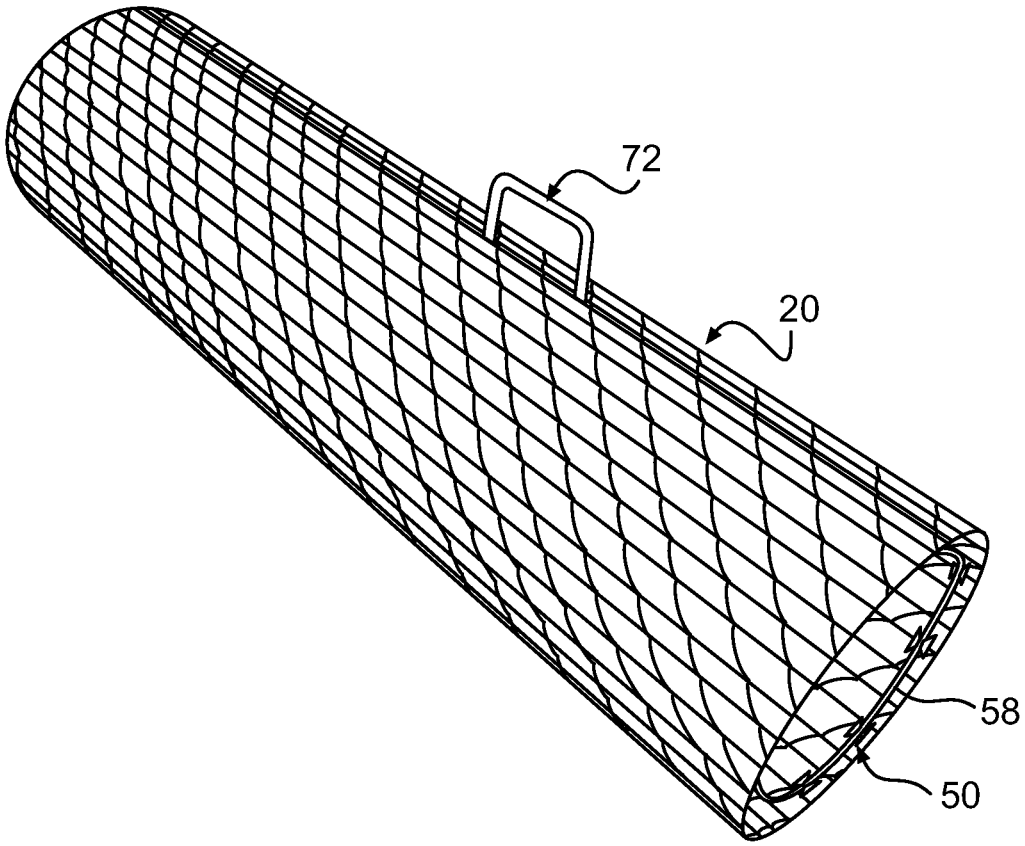
FIG. 16 is a perspective view of a rolled-up security barrier ready for storage.
Figure 17:
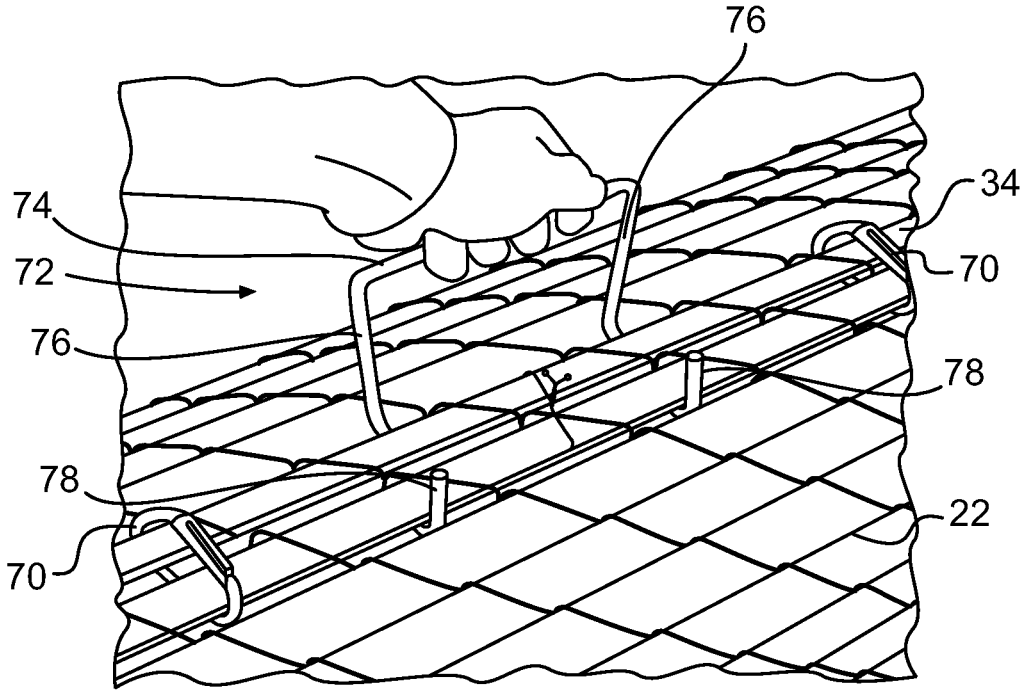
FIG. 17 is a perspective view of a removable handle attached to a rolled-up security barrier.

Alternatively, the bundled security barrier system 10 may be detached from mounting surface 80 and placed in storage. One or more handles 72 may be removably attached to the bundled security barrier system 10 to facilitate and simplify handling. As shown in FIGS. 16-17, handle 72 can have a grip member 74, preferably having a curved configuration adapted to ergonomically conform to the palm of a user's hand, attached to two side members 76. The distal end of each side member 76 includes a hook 78 adapted to latch onto frame member 20. As shown, hooks 78 may be inserted through sections 26 and retain one or more slats 34 of frame member 20. In one embodiment, handle 72 is preferably removably attached midway along the bundled security barrier system 10 along a central region of frame 20, enabling one individual to carry the bundled security barrier 10. Alternatively two handles 72 can be positioned adjacent to opposing side of the bundled security barrier system 10, allowing two individuals can bear the load of a single bundled security barrier system 10. Furthermore, it may be possible to grip two or more handles 72, attached to two or more rolled-up frames of security barrier system 10, using one hand.

Figure 18C:
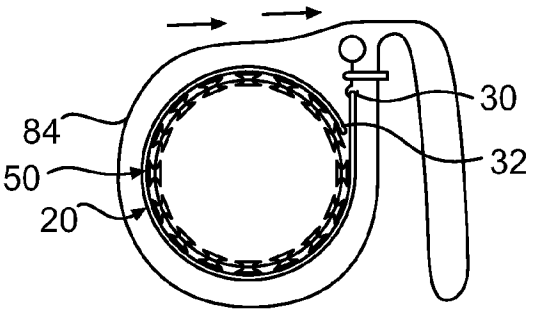
FIG. 18(*a*) is a schematic diagram showing an exemplary means for rolling-up the security barrier, wherein the security barrier is oriented in a fully deployed position.
Figure 18B:
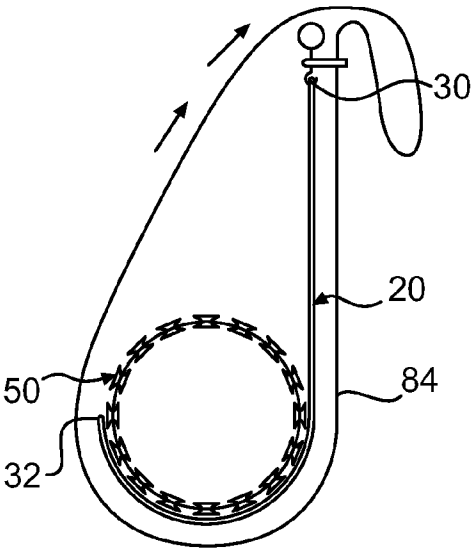
Figure 18A:
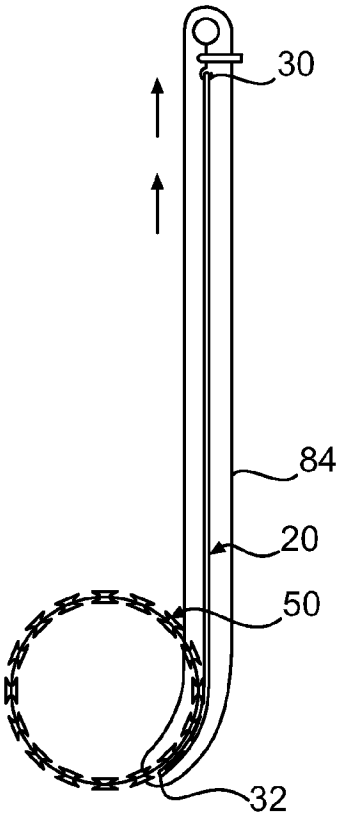

In another embodiment shown in FIGS. 18(*a*)-18(*c*), one or more cords 84 may be used to retract and draw security barrier system 10 into a rolled-up storage configuration. When the security barrier system 10 is in use and deployed on a water vessel, cord 84 encircles and forms a loop around frame member 20, as shown in FIG. 18(*a*). When security barrier system 10 is ready to be retracted, the cord 84 can be maneuvered to further surround the coiled strand of razor wire 50. As shown in FIGS. 18(*b*)-18(*c*), by pulling on one end of the looped cord 84, the lower frame member end 32 is drawn up around the coiled strand of razor wire 50 and towards upper frame member end 30 so as to completely encircle razor wire 50. Once the security barrier system 10 is completely retracted and arranged as a storage roll, shown in FIG. 18(*c*), cord 84 can be used to help secure the bundle while providing an additional means by which the security barrier system 10 can be grabbed to facilitate transport and storage. In an exemplary embodiment, one cord 84 may be positioned at one end of security barrier system 10 while another cord 84 may be positioned at the opposite end of the security barrier system 10 to facilitate retraction. Each cord 84 is preferably constructed from stainless steel wire rope having a diameter of about 0.125 inches and may be about 10 feet in length.

FIGS. 18(*a*)-18(*c*), depict the retraction of a security barrier system 10 having only one frame member; it is understood, however, that loop cord 84 can be positioned around two or more vertically attached frame members of a security barrier system 10 to similarly retract a multi frame member security barrier system 10.

The overall design and various individual features of security barrier system 10 of the present invention have a number of advantages. Security barrier system 10 provides a formidable physical barrier and visual deterrent that inhibits trespass onto a water vessel. Specifically, the strands of razor wire 50, abrasive elements 42, electrified frame member 20 and warning notices printed on slats 34 and/or screen 40 deter unauthorized boarding of a water vessel by pirates and other trespassers. Furthermore, the inclusion of slats 34 in frame member 20 prevents trespassers from scaling security barrier system 10.

Security barrier system 10 can further includes a number of grapple resistant features that prevents removal of razor wire 50 and/or frame member 20 from a water vessel. For example, slats 34 minimize openings in the chain link body of frame member 20 onto which a grapple hook may latched. Additionally, multiple strands of razor wire 50 can be separately attached to different portions of frame member 20 and/or to multiple frame members 20 in order to prevent all the strands of razor wire 50 mounted to one or more frame members 20 from being pulled away in a single run when a strand of razor wire 50 is snagged by a grapple hook. Similarly, each strand of razor wire 50 can include multiple brake away means 51 that separates razor wire 50 into a plurality of sections; when a portion of the razor wire 50 is snagged by a grapple hook, brake away means 51 prevents adjoining portions of the razor wire 50 from being pulled down by the grapple hook. Thus, at most, only a single strand of razor wire 50 or only a portion of a strand of razor wire 50 is removed when snagged by a grapple hook. Because security barrier system 10 can be configured as a plurality of independent, modular frame members 20 each of which can be individually attached to a surface of the water vessel, if a grapple hook were to latch onto a frame member 20, the adjoining frame members 20 would not be torn away from the water vessel. Moreover, the various components of security barrier system 10 are constructed from high strength, corrosion resistant materials that enable security barrier system 10 when mounted to a water vessel to resist being torn away from the water vessel.

Security barrier system 10 can also easily and safely installed, deployed, stored and redeployed as desired. To facilitate installment, security barrier system 10 can be manufactured as an assembly of multiple, removably interconnected modular frame members 20. Furthermore, security barrier system 10 can be rapidly and easily attached to and suspended from preexisting mounting surfaces of a water vessel using suspension fasteners 70, such as snap hooks, of security barrier system 10. Suspension fasteners 70 also enable the quick release and removal of security barrier system 10. Furthermore, suspension fasteners 70 and chains may be used to easily adjust the location of security barrier system 10 relative to a railing, bulwark or other structure, as desired. A common boat hook 71 may be used to quickly roll-up security barrier system 10 when deployed along a side of a water vessel for storage. Fasteners may be used to lock security barrier system 10 in its rolled-up configuration, wherein the strand of razor wire 50 is fully enclosed and wrapped within frame member 20, to facilitate storage and handling. Thus oriented, slats 34 cover, prevent exposure of and prevent user contact with razor wire 50, thereby allowing security barrier system 10 to be easily and safely handled. In this rolled-up configuration, at least 48 security barrier systems 10 can be stored in a standard 20 foot ocean cargo container, which when deployed, may protect about 288 linear fee of a water vessel's perimeter. Preferably, security barrier system 10 is compact and weighs less than about 40 pounds to further facilitate handing by a single individual. To facilitate later deployment, the rolled-up security barrier system 10 may be left attached to the side of a water vessel. Security barrier system 10 may be easily and rapidly redeployed as desired as well as transferred to other vessels for later use.

Security barrier system 10 is also inexpensive to manufacture and maintain. Security barrier system 10 may be constructed from inexpensive, mass produced, widely available components that can be quickly assembled in a factory setting. Since the various components of security barrier system 10 may be constructed from corrosion resistant, high strength, durable materials, little maintenance is required to keep security barrier system 10 in working order. Additionally, by virtue of its modular design, individual components of security barrier system 10, such as one or more modular frame members 20, may be repaired and/or replaced as necessary, without requiring repair and/or replacement of the entire system.

Security barrier system 10 is particularly well suited to protect a water vessel. The size, shape and suspension fasteners 70 of security barrier system 10 may be customized to accommodate a wide range of water vessels. Alternatively, security barrier system 10 may be attached to and used with other structures, such as buildings. The dimensions of security barrier system 10 may be customized to a particular application as necessary. Additionally, the coloring and warnings printed on frame member 20 may be customized depending upon the application.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A security barrier system for a water vessel comprising:
- a first frame member, wherein the first frame member comprises:
  - a flexible wire body, and
  - a plurality of slats attached to the flexible wire body;
  - a first strand of razor wire attached to the flexible wire body and extending substantially along a longitudinal axis of the plurality of slats, wherein the first frame member is adapted to wrap around the first strand of razor wire so as to substantially enclose the razor wire within the first frame member when the first frame member is oriented in a storage orientation; and
  - a suspension fastener attached to an upper portion of the first frame member that is adapted to suspend the first frame member from and removably attach the first frame member to a surface of a water vessel.

2. The security barrier system of claim 1, wherein the flexible wire body has a chain linked fence configuration.

3. The security barrier system of claim 1, wherein the first frame member further comprises: a first elongated bar attached and oriented parallel to an upper end of the first frame member, wherein the suspension fastener is attached to the first elongated bar, and a second elongated bar attached and oriented parallel to an upper end of the first frame member.

4. The security barrier system of claim 1, wherein said plurality of slats are horizontally attached to said flexible wire body so as to form a substantially continuous surface that substantially prevents exposure of the first strand of razor wire on one face of the first frame member.

5. The security barrier system of claim 1, wherein the first strand of razor wire has a coiled configuration and is positioned at a lower end of the frame member.

6. The security barrier system of claim 5, further including a second strand of razor wire having a coiled configuration, wherein the second strand of razor wire is attached to the flexible wire body and horizontally spaced apart from the first strand of razor wire.

7. The security barrier system of claim 5, wherein the flexible wire body has a height of at least about a circumference of the coiled razor wire and a width of at least about the width of the coiled razor wire.

8. The security barrier system of claim 5, further including a second strand of razor wire having a coiled configuration, wherein the second strand of razor wire is attached to the flexible wire body and is vertically spaced apart from the first strand of razor wire.

9. The security barrier system of claim 8, wherein the distance between the first and second strands of razor wire is at least equal to the larger coil circumference of either the first or second strands of razor wire.

10. The security barrier system of claim 8, wherein the first strand of razor wire is positioned adjacent to an upper end of the first frame member and the second strand of razor wire is positioned adjacent to a lower end of the first frame member.

11. The security barrier system of claim 1, wherein the first strand of razor wire includes a breakaway means.

12. The security barrier system of claim 11, wherein the breakaway means is selected from the group consisting of a score line formed on the first strand of razor wire and a sleeve for connecting two ends of the first strand of razor wire.

13. The security barrier system of claim 1, wherein the frame member further comprises a plurality of spikes attached to the flexible wire body.

14. The security barrier system of claim 1, further comprising a power source operatively associated with the first frame member for electrifying the first frame member.

15. The security barrier system of claim 1, further comprising a cord positioned around the first frame member that facilitates retraction of the security barrier.

16. The security barrier system of claim 1, further comprising magnets attached to a rear surface of the first frame member.

17. The security barrier system of claim 1, further comprising a handle removably attached to the first frame member.

18. The security barrier system of claim 1, further comprising a second frame member removably attached to the first frame member.

19. A security barrier system for a water vessel comprising:

a water vessel, wherein said water vessel comprises a mounting surface; and a security barrier system suspended from the mounting surface, wherein the security barrier system comprises:

a frame member comprising:

a flexible wire body, and a plurality of slats attached to the flexible wire body;

a strand of razor wire attached to the flexible wire body and extending substantially along a longitudinal axis of the plurality of slats, wherein the frame member is adapted to wrap around the strand of razor wire so as to substantially enclose the razor wire within the frame member when the frame member is oriented in a storage orientation; and a suspension fastener attached to an upper end of the frame member and adapted to suspend the frame member from the mounting surface of the water vessel.

20. A method for using a security barrier system to prevent trespass onto a water vessel, wherein the method comprising the steps of:

providing the security barrier system of claim 1;

deploying the security barrier system by suspending the frame member from a mounting surface of the water vessel using the suspension fastener;

removing the security barrier system by detaching the frame member from the mounting surface of the water vessel; and storing the security barrier system by wrapping the frame member around the strand of razor wire so as to substantially enclose the razor wire within the frame member.

* * * * *